US005451758A

United States Patent [19]

Jesadanont

[11] Patent Number: 5,451,758

[45] Date of Patent: Sep. 19, 1995

[54] AUTOMATIC NON-COMPUTER NETWORK NO-STOP COLLECTION OF EXPRESSWAY TOLLS BY MAGNETIC CARDS AND METHOD

[76] Inventor: Mongkol Jesadanont, 386/2 Soi Chalermsuk (Pahonyothin 28), Jatujak, Bangkok, 10900, Thailand

[21] Appl. No.: 164,041

[22] Filed: Dec. 8, 1993

[51] Int. Cl.[6] ..... G07B 15/00

[52] U.S. Cl. ..... 235/384; 340/928

[58] Field of Search ..... 235/384, 380, 382; 340/928

[56] References Cited

U.S. PATENT DOCUMENTS

| | | | |
|---|---|---|---|
| 4,303,904 | 1/1981 | Chasek | 235/384 |
| 4,501,958 | 2/1985 | Glize et al. . | |
| 4,555,618 | 11/1985 | Riskin . | |
| 4,675,824 | 6/1987 | Kiyama et al. . | |
| 4,963,723 | 10/1990 | Masada | 235/380 |
| 5,083,200 | 1/1992 | Deffontaines . | |
| 5,086,389 | 2/1992 | Hassett et al. | 340/928 |
| 5,101,200 | 3/1992 | Swett | 340/928 |
| 5,144,553 | 9/1992 | Hassett et al. | 235/384 |
| 5,204,675 | 4/1993 | Sekine | 340/928 |
| 5,310,999 | 5/1994 | Claus et al. | 235/384 |

FOREIGN PATENT DOCUMENTS

| | | | |
|---|---|---|---|
| 0425961 | 10/1990 | European Pat. Off. . | |
| 2-183389 | 7/1990 | Japan . | |
| 9003016 | 3/1990 | WIPO | 235/384 |

*Primary Examiner*—John Shepperd
*Attorney, Agent, or Firm*—Poms, Smith, Lande & Rose

[57] ABSTRACT

An automatic system and method using prepaid cards for collection of the expressway tolls while the vehicle is moving at a normal driving speed where a computer-network is not required. Upon insertion of a valid prepaid card with a sufficient cash balance to pay the maximum toll for an expressway into a card reader/writer of an in-vehicle device, the device is turned 'ON'. A transmitter in the device is actuated to continuously transmit an infrared signal to cancel the activation of an alarm at the toll facility and to activate a transmitter of the toll facility to transmit an infrared signal of a predetermined modulation frequency identifying each toll facility. A data processing means of the in-vehicle device calculates toll using information from the infrared signals received one at the entrance and another at the exit and reduces toll from the cash balance in the prepaid card. The card reader/writer rewrites the resulting amount onto the card. When the cash balance is less than the maximum toll, upon insertion of the card in the in-vehicle device an alarm is actuated to notify the driver. The prepaid card used can be a magnetic card. When the driver insists to pass through the automatic toll collecting booth without proper means for paying toll, an alarm at the toll facility is actuated together with a camera to take the picture of the license plate of the invader's car.

8 Claims, 21 Drawing Sheets

CPU = Central Processing Unit

PRIMARY SET

CPU = Central Processing Unit

SECONDARY SET

CPU = Central Processing Unit

CPU = Central Processing Unit

No. 1, 2, 3 =entrances

No. 7, 8, 9 = exits

PRIOR ART

AUTOMATIC NON-COMPUTER NETWORK NO-STOP COLLECTION OF EXPRESSWAY TOLLS BY MAGNETIC CARDS AND METHOD

BACKGROUND OF THE INVENTION

At present, it is most difficult to maintain a smooth flow of traffic due to the ever-increasing traffic loads especially on those heavily traveled toll roads. With those conventional systems even one with a large number of personnel for issuing tickets or collecting tolls from motorists, this takes quite sometime for each car before being able to pass the toll plaza. Thus, during rush hour the traffic is almost always paralysed which causes consequent irritation and tiredness; and very important, an incredible waste of fuel and time. In addition, such traffic jams causes great pollution as huge amount of carbon monoxide is produced. These all cause substantial inconvenience to travelers including a great waste of fuel in the country.

Many systems have been proposed to use radio frequency identification (RFID) techniques for toll collection where drivers acquire a "tag" or card that acts as a reflective transmitter or discrete transmitter to identify the vehicle by serial number as it passes through a toll booth. This technique is referred to as Automatic Vehicle Identification (AVI).

Using the AVI system, a great burden is imposed on the toll agencies to handle hundreds of thousands of individual accounts in addition to a need to invest a huge amount of capital to establish a mainframe computerized network system due to the fact that the RFID tag lacks a machine-intelligent processor for manipulation and storage of accounts such that individual toll accounts for all users must be maintained. And since the RFID tags lack a processor or user interface, vehicle operators cannot readily ascertain account balances, and have no warnings as to limited or exhausted credit. Both confusion and safety hazards can be created as drivers cross over to conventional toll collection lanes with little warning.

User-privacy is also disturbed by using the RFID system since generation and storage of detailed vehicle-specific travel records and identification is required.

Another system, U.S. Pat. No. 5,086,389, has been proposed to overcome those above mentioned deficiencies using an in-vehicle toll processor or in-vehicle component (IVC), which is purchased or leased by vehicle operators. The IVC controls and processes toll-related debit/credit transactions, including extraction of toll charges, by communicating with two transmitter modules operated by the toll authority located at the toll plaza. Such system though being improved to a certain level, yet still suffers from such inconvenience that the vehicle operator has to carry the IVC to the toll authority agent at a toll credit facility to load the IVC with a value representative of an initial toll-money-available quantity he purchased. It is very desirable to use a portable card system where vehicle operator can purchase something like two cards in advance and therefore can abolish this inconvenience since the driver can use the other purchased card right when the previous one does not have sufficient amount of toll left with no need to stop for IVC loading like that in the system using IVC. The next purchase of the magnetic cards can be done any time at his convenience. This also preserves the privacy of users in addition to providing him, a receipt which can facilitate charging of the toll as a business expense.

The present invention is an automatic toll collection system which requires no stoppage of vehicle as it passes a given toll charged point at normal driving speeds up to 180 mph (300 kph) and in addition, does not require the presence of employees of the toll-levying authority. Those systems requiring computerized net work system would need very large amount of capital to install and would come up with all the formidable tasks such as billing and information updating as what proposed in the prior arts (U.S. Pat. Nos. 4,555,618, 4,675,824, and 5,086,389; EP-A-2 0425961). Yet, another toll-collection system of Claus et al. (U.S. Pat. No. 5,310,999) using the data signals for transmission through the air as the radio frequency (RF) range from 902 to 928 MHz where a vehicle-mounted unit communicates with two antennas to make toll payments and transfer data to/from a smart card which is inserted therein. This system although has been improved to a near perfect extent, yet still suffers from the fact that the cost of a smart card is quite expensive and much greater than the presently available magnetic cards or optically coded cards. The use of new technologically available cards of debit type would offer both privacy of the users and a secure antifraud mechanism including a less expensive way of making toll payments. In addition, their system also suffers from the fact that by using the RF as means for paying toll, there would always be quite great chances that communications for making toll payment in such system can be easily interfered either intentionally or unintentionally. The situation is worse when the toll facilities located near the airport with greater interference which is quite likely for such chance to happen. By selling of a portable card with a pre-set value makes it possible to reduce the total amount of cash handled and in this way promotes better securities for the authority operating at the charged point in addition to abolishing the burden of periodic billings to the customers by the grantors as in the case where credit card systems are used.

The prepaid card system or the like such as the optically coded cards like that of LGZ Landis & Gyr Zug AG, Zug, Switzerland (U.S. Pat. No. 5,101,184; date of Patent, Mar. 31, 1992) allows the grantor to collect cash in advance before the action of passing the charged point takes place which should be most desirable for any investment than to collect after the action took place which sometime may encounter those bad accounts with no or not sufficient amount of money to be deducted.

The objectives of the present invention are:

(1) to provide a system which is very simple, convenient and can be very easily handled and maintain the users' privacy, yet is highly effective and at very low cost of investment for collection of toll for utilization of any expressways or any places where using of cars is involved;

(2) to provide a system which will speed up the flow of traffic through toll plazas, where traffic becomes paralysed or near paralysed during rush periods;

(3) to provide advantages to vehicles drivers or owners as the elimination of time required to stop a vehicle to pay a toll, and that the passage of a vehicle through a toll station can be possible at a normal driving speed;

(4) to provide advantages to a vehicle owner or driver by minimizing congestion at toll plazas, and to increase economical fuel usage by eliminating stop-and-go driving;

(5) to promote driver convenience by eliminating the need to locate coins or bills to pay tolls as he approaches toll plazas; or to carry any socalled "in-vehicle component" to the toll authority to be loaded with a toll credit;

(6) to reduce the number of authority needed for operating at the toll station, i.e., the toll booth operators;

(7) to reduce the total amount of cash flow through the toll system, that cash that must be count and picked up at toll plazas and transported in armored vehicles can be greatly reduced, therefore promotes better securities for the authority;

(8) to eliminate the need of billing system in such case that credit card issued by a particular grantor is used by the motorists in a computerized-network credit-type of toll collection method, which is quite a great burden;

(9) to allow a particular portable card grantor to collect cash for payment of tolls in advance right even before the passing of the expressway takes place;

(10) to allow a fair collection of tolls such that on an expressway having a plurality of exits, the driver will pay according to the distance, the longer the more expensive,

(11) to reduce the possibility of serious car accidents which is most likely can happen when those with speed as high as 55 m.p.h. have to come to a full stop to pay toll, especially in those poor weather conditions.

SUMMARY OF THE INVENTION

According to the present invention, as embodied and broadly described herein, an automatic system for collection of toll from a vehicle moving at a normal driving speed along a roadway is provided, where the amount of toll charged is proportional to the distance between the entrance and the exit a vehicle operator drives.

A toll collection system comprises of basically two components, a primary set and a secondary set.

1. The primary set is installed at each toll booth, both at the entrance and the exit. Such primary set is powered by an alternating current.
2. The secondary set, powered by a direct current, is installed onboard in the moving vehicle while it passes the entrance or the exit at a normal driving speed. The power supply can be provided from battery of the vehicle.

From the primary set, a light source section of a photoelectric light obscuration detector unit emits a light beam to detect the presence of a vehicle approaching entrance and exit. Blocking of the light beam causes actuation of camera unit and a voice alarm unit. In case where there is no secondary set in the passing vehicle or the secondary set is out order, or the signal from the secondary set is not correct; or the magnetic card is not intact, or is not or not properly inserted in the magnetic card reader/writer of the secondary set, or having the amount of money not sufficient to pay the maximum toll for the longest distance of that expressway, when such vehicle insists to pass through the automatic toll booth, the alarm within the primary set is activated and buzzes to notify the authorized personnel of the evasion. The camera within the primary set is also actuated to take the picture of the evading vehicle together with its license plate.

In such situation where secondary set is used in the passing vehicle with an intact magnetic card having amount of money sufficient for paying of the maximum toll to be paid for that expressway inserted in the magnetic card reader/writer of the secondary set, the infrared transmitter in the secondary set will be activated to transmit the infrared beam to the primary set. Only when the receiver in the primary set received a correct infrared signal of specific frequency from the secondary set that the comparator compares the signal and sends the data to the central processing unit (CPU) in the primary set which will cause delay and then will cancel the actuation of the alarm and the camera in the primary set.

At each entrance and exit, an infrared transmitter of the primary set is pretuned to emit an infrared beam of a predetermined modulation frequency identifying each toll facility to be detected by the receiver in the secondary set. This predetermined modulation frequency is specific and belongs to only one certain toll facility and is different from that of any other toll facilities. The comparator in the secondary set compares the signal of predetermined modulation frequency received from the primary set and sends information to the CPU of this secondary set, where CPU of secondary set will store the information in its memory and calculate toll from the two predetermined modulation frequencies of infrared beams received, one at each entrance and one at each exit, and thereby deduct the toll from the amount of money present in the card. The card reader/writer is instructed to rewrite new cash balance onto the card. When the amount of money left in the card is too low to pay the maximum toll for the longest distance in that expressway, the alarm notifies the driver not to enter the automatic toll booth. The vehicle driver needs to buy a new card and get the money left in previous card refunded from the toll authority.

BRIEF DESCRIPTION OF THE DRAWINGS

The accompanying drawings, which are incorporated in and constitute a part of this specification, illustrate a preferred embodiment of the invention, and together with the description, serve to explain the principles of the present invention, where a method of paying toll by a vehicle passing through a toll charged point a normal driving speed is described.

FIG. 9 shows how Primary set is installed at each entrance and exit while there is no vehicle passing in;

DESCRIPTION OF THE PREFERRED EMBODIMENT

The present invention composed mainly of two sets of electronic equipment and the infrared signals used as communicating means between these two sets of equipments are in the range of 30–60 kilohertz (kHz). This system conceptually does not require any computer network to manage especially those huge and costly ones. These two sets of equipments are.

Figure 1:
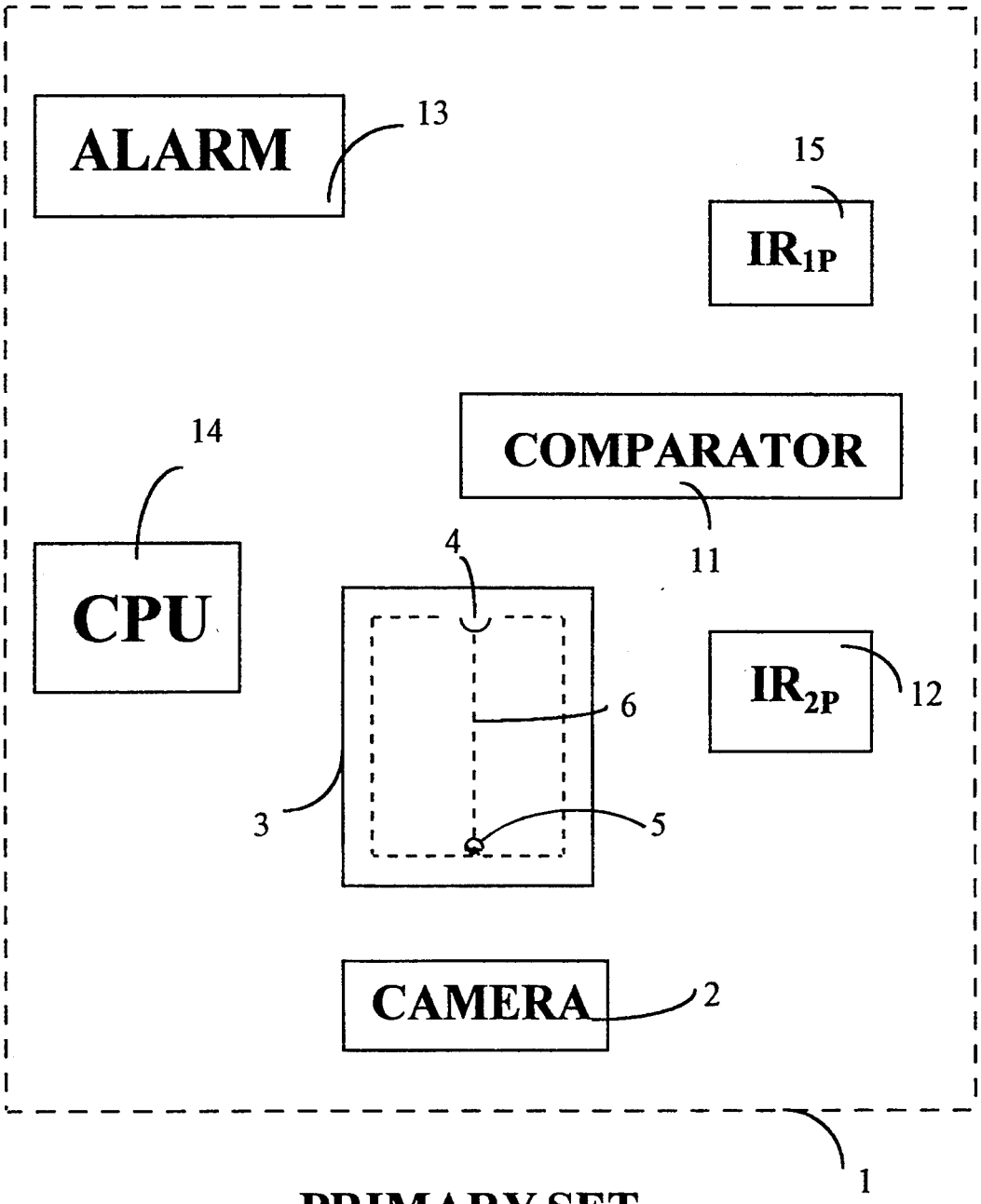
FIG. 1 is a block diagram showing all the components in a Primary set.

1. Primary set 1 (FIG. 1)

Figure 4:
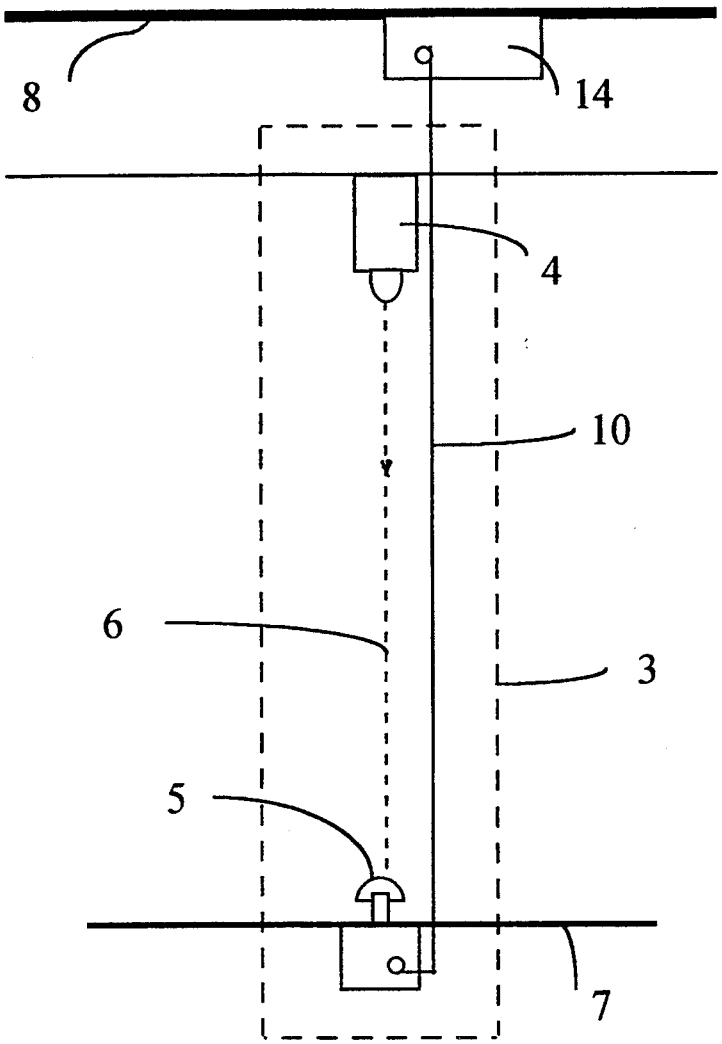
FIG. 4 shows a light source section and a photosensitive receiving device section of photoelectric light obscuration detector unit.

(powered by alternating current) which is installed by mounting beneath and at the leading edge of ceiling 8 of the canopy of every entrance and every exit 9 (as in FIG. 9), composed of 1.1 Camera unit 2, which connects to CPU 14;

1.2 Photoelectric light obscuration detector unit 3 (as shown in FIG. 4), this unit consists of 1.2.1 A light source section 4, and 1.2.2 A photosensitive receiving device section 5 (such as a photo-diode), where the light source section 4 emits a light beam 6 all the time to be received by the photosensitive receiving device section 5 installed on ground 7 as shown in FIG. 4.

Figure 2:
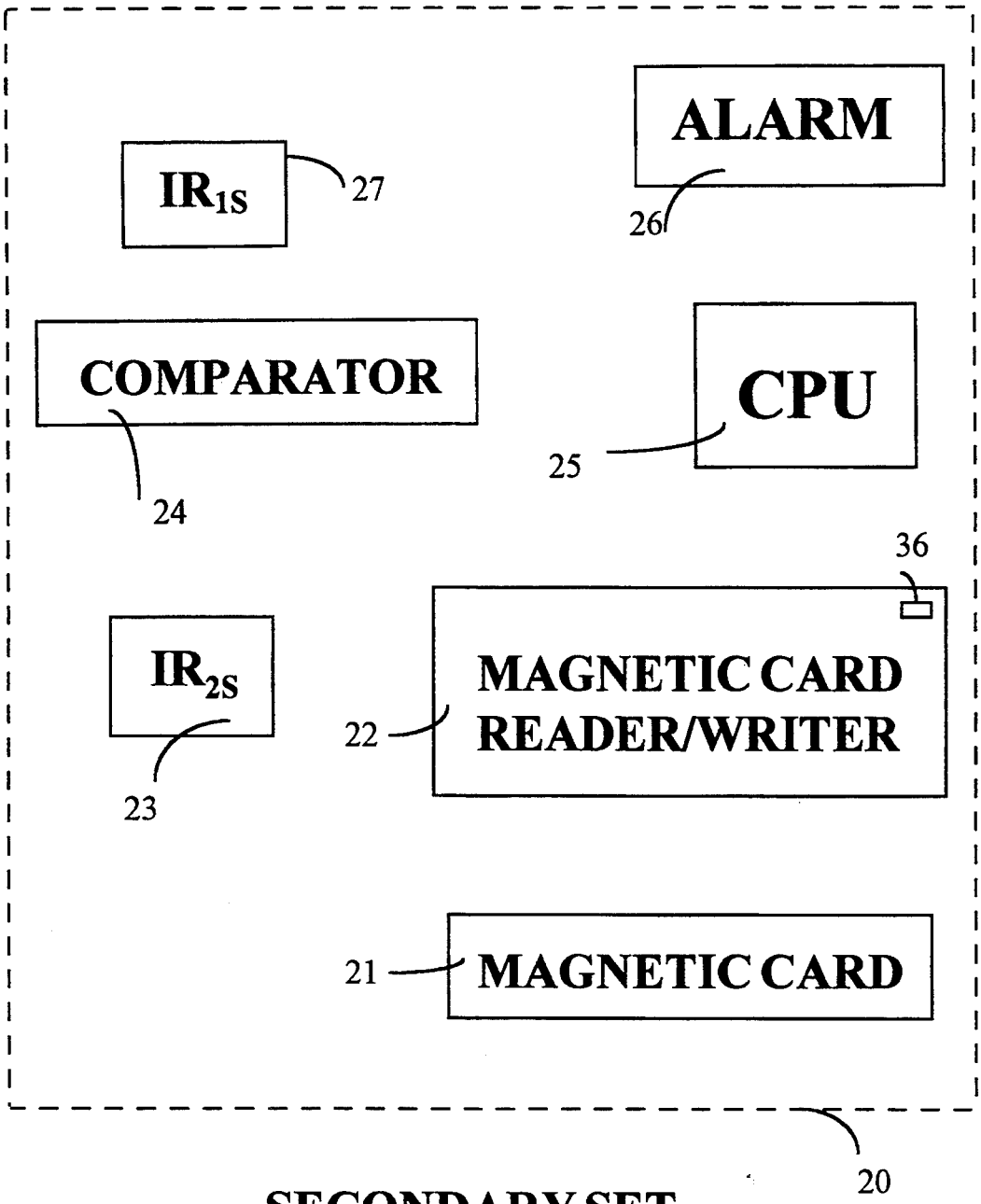
FIG. 2 is a block diagram showing all the components in a Secondary set.
Figure 3:
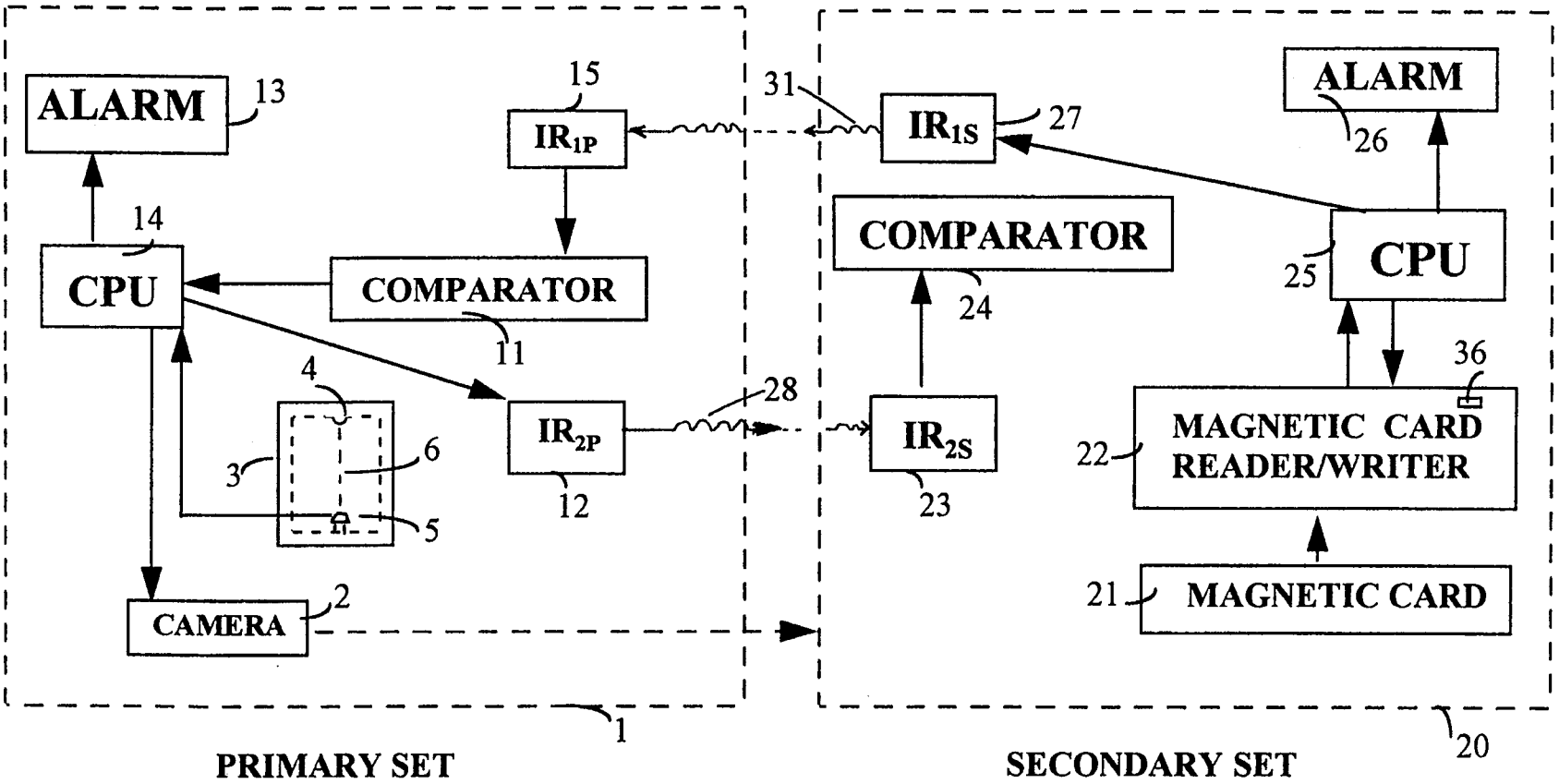
FIG. 3 is a block diagram showing how all the components in Primary set and Secondary set of this invention interact.

From the photosensitive receiving device section 5, there is an electrical cord 10 connected to CPU 14 (as shown in FIG. 4, but not shown in other figures);

1.3 Comparator Unit 11, this unit compares the signal received by receiver unit $IR_{1P}$ in Primary set from transmitter unit $IR_{1S}$ in Secondary set and comparator unit 11 then sends data to CPU 14;

1.4 Infrared transmitter unit $IR_{2P}$ 12 (here 'P' means the unit belongs to Primary set 1), is a transmitter to transmit an infrared signal of a predetermined modulation frequency shown as signal 28 in FIG. 3. The signal 28 is of a predetermined modulation frequency which is specific only for that certain entrance or exit and is different from that of all the other entrances and exits. This transmitted signal is to be received by an infrared receiver unit $IR_{2S}$ in the Secondary set;

1.5 Voice alarm unit 13, this gives a warning sound to notify the toll authority when the automobile passes entrance 9 in the situations not allowed by the toll agency like that in case I to case III. This alarm 13 is connected to CPU 14;

1.6 Central processing unit (CPU) 14, is a microprocessor capable of processing the data received from comparator 11 and photoelectric light obscuration detector unit 3, and commanding transmitter unit $IR_{2P}$ 12 to transmit a predetermined modulation frequency infrared signal 28, and delaying the actuations of alarm 13 and camera 2;

1.7 Infrared receiver unit $IR_{1P}$ 15, is a receiver capable of receiving the signal from the transmitter in the Secondary set and send the data to comparator unit 11;

2. Secondary set 20 (FIG. 2)

(powered by direct current from automobile) which is installed under the front glass windshield 29 of the automobile 30, consists of 2.1 Card 21 (FIG. 6), having all the features and functions identical to presently available conventional telephone cards. This can be magnetic card or the like such as optically coded card;

2.2 Card reader/writer unit 22, having all the features and functions identical to presently available conventional telephone-card reader/writer and is connected to CPU 25;

2.3 Infrared receiver unit $IR_{2S}$ 23, ('S' means the unit belongs to Secondary set 20), is a receiver to receive the fixed frequency infrared signal 28 from infrared transmitter unit $IR_{2P}$ 12 of Primary set 1 and sends the data to comparator unit 24;

2.4 Comparator unit 24, compares the signal received by the receiver unit $IR_{2S}$ 23 and then sends the data to central processing unit 25;

2.5 Central processing unit (CPU) 25, is a microprocessor controlling unit, which includes also ROM (read-only-memory element) and RAM (the random access memory element); CPU is the component capable of processing the data received from the other units in Secondary set 20, executing the calculation of tolls, and commanding the other units of Secondary set 20 to function according to processed results;

2.6 Voice alarm unit 26; is connected to CPU 25, capable of giving a warning sound;

2.7 Infrared transmitter unit $IR_{1S}$ 27 is a transmitter to transmit infrared signal 31 to be received by receiver $IR_{1P}$ 15 of Primary set 1. Transmitter unit $IR_{1S}$ 27 sends the signal 31 which can be of any specific frequency that is set by the toll authority. All Secondary sets in all the automobiles must have transmitter units $IR_{1S}$ 27 that transmit signal 31 of the same frequency that can be received by the receiver unit $IR_{1P}$ 15 of the Primary set 1. This is different from the predetermined modulation frequency infrared signal transmitted from the transmitter unit $IR_{2P}$ 12 where infrared signal 28 is transmitted. The signal 28 is of a specific predetermined modulation frequency identifying each toll facility assigned by the toll authority which is different from that of any other toll facilities of the expressway 35.

A flow diagram in FIG. 2.1 shows the various steps performed by the components in the secondary set as the vehicle approaches the automatic toll facility. Knowing that the vehicle is approaching entrance at about one half mile or farther away from the toll booth, the driver inserts the portable debit card into the reader/writer unit of Secondary set. This turns the device on and the CPU checks all the components and leaves them at "STANDBY" mode. CPU checks if there is a card in the card reader. When a card is present, PASSWORD and NUMBER OF COUNT in the card are read. Password is recorded in a READ-ONLY track, while number of count is recorded in the READ/-WRITE track in the card, as indicated by A and B tracks, respectively shown in FIG. 6.

Where there is no password, CPU activates alarm and all the components are back to "STANDBY" mode.

When there is no password, CPU then checks NUMBER OF COUNT. If there is no count, the display screen of the reader/writer shows the word "CARD EMPTY" alphabetically and all then back to "STANDBY". If number of count is less than the count for maximum toll information recorded in ROM, screen displays "TOO LOW VALUE" and alarm is activated then all back to "STANDBY". When number of count is equal or greater than maximum toll, screen then displays "OK" and all the components are ready to function. The transmitter of the Secondary set is actuated to continuously transmit an infrared signal of preset specific frequency to communicate with the transceiving means of Primary set at the toll booth as the vehicle proceeds through the automatic toll collection booth. When receiver in the Primary set at the entrance receives correct infrared signal from Secondary set, the transmitter of the Primary set is activated and transmits an infrared signal identifying that toll booth. The receiver of Secondary set receives the signal and the data is stored in the memory as $DATA_1$. The vehicle then proceeds to the exit. The data exchange between the Primary set at the exit and the Secondary set in the vehicle is in the same manner as that at the entrance. However, the infrared signal transmitted at the exit is of a different predetermined modulation frequency and is stored in the memory as $DATA_2$. When there are both data in the memory, CPU compares with combination of the two signals and the number of count down assigned for each combination from the information stored in ROM. The count down needed is then defined and subtracted from the number of count present in the debit card. Reader/writer is then instructed to rewrite the resulting new number of count onto the card then back to "STANDBY" mode. In case the number of count left is zero, screen then displays "CARD EMPTY". The card reader/writer is conventional in design and construction where the Secondary set can be constructed according to known transceiver and microprocessor control principles. The Secondary set can be housed in a compact portable embodiment for removable attachment to a dashboard surface or other convenient location within the vehicle.

Figure 5:
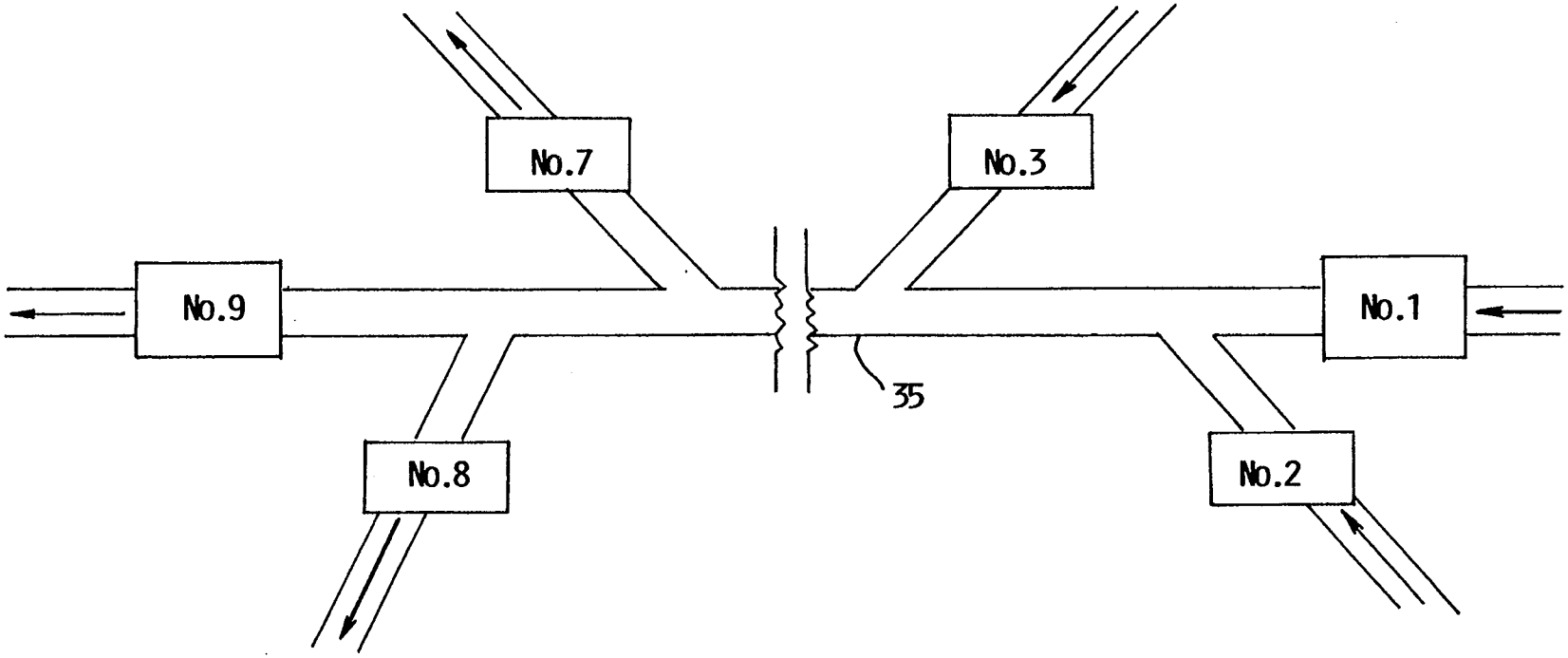
FIG. 5 shows a schematic block diagram of an expressway with several entrances and exits.
Figure 8:
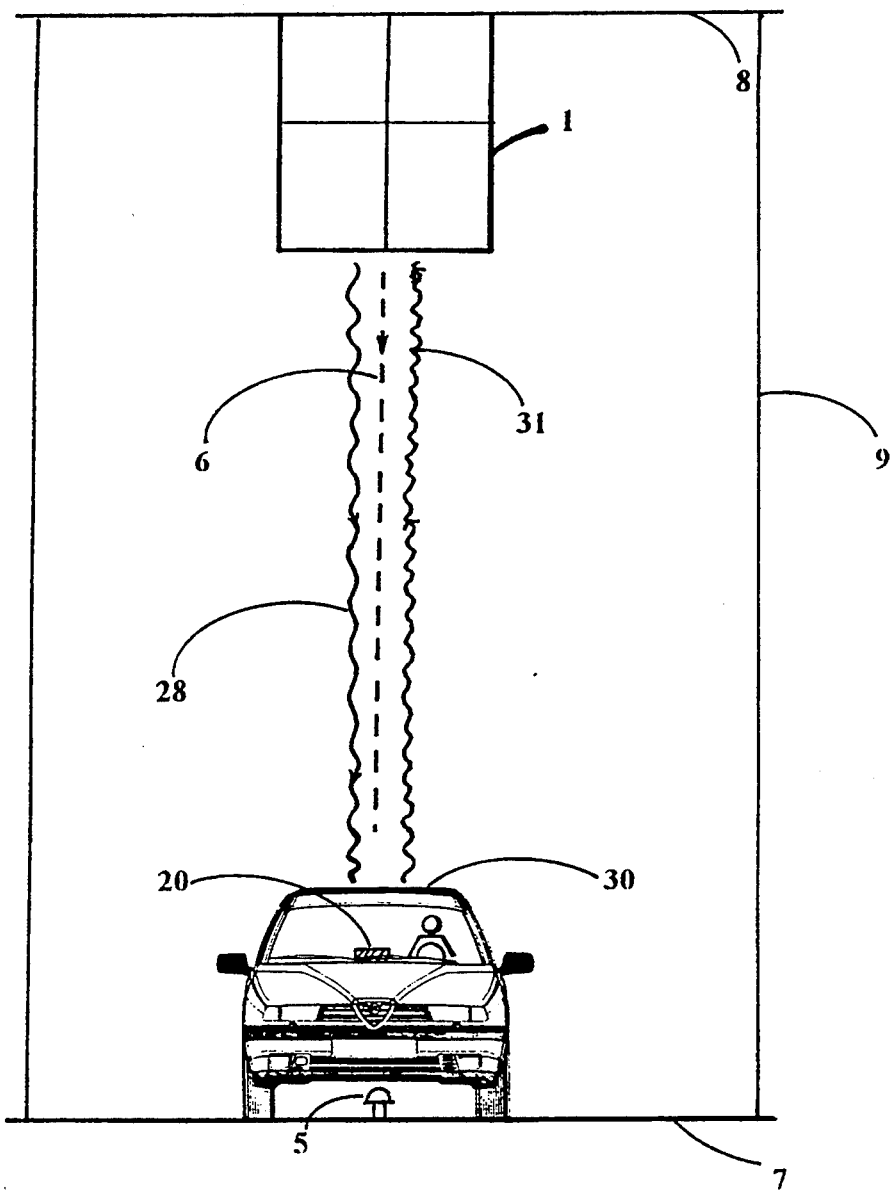
FIG. 8 shows a front view of an automobile passing into the entrance or exit of the expressway.
Figure 9:
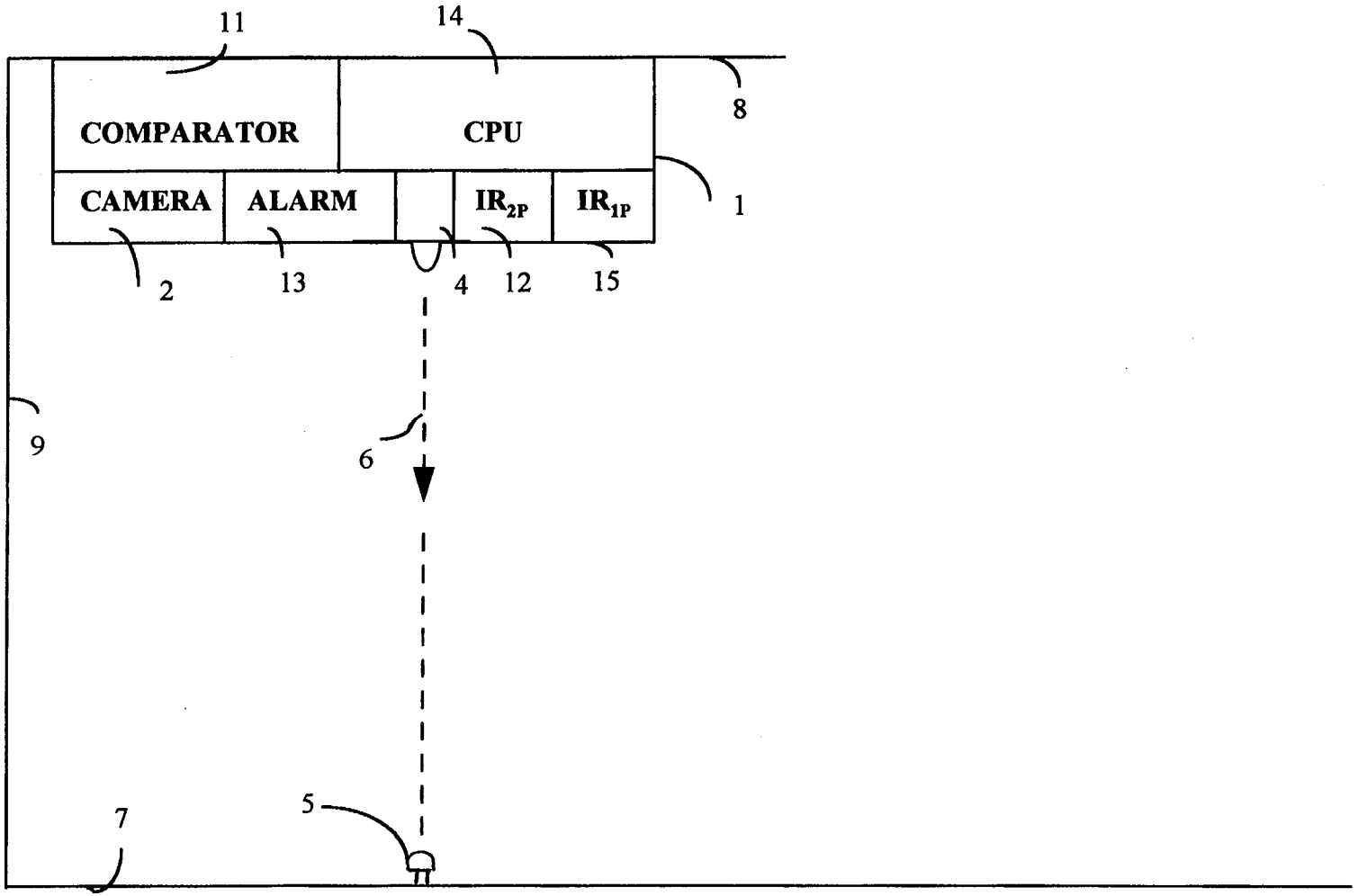

FIGS. 8 and 9 show how the Primary set 1 is installed at each entrance and each exit of the expressway 35 (FIG. 5). This is the situation where there is no automobile passing at the entrance 9, light source section 4 of the photoelectric detector 3 which is installed at the ceiling 8 of entrance 9 emits a light beam 6 vertically and downwardly towards the photosensitive receiving device section 5 at ground 7 all the time. Camera 2 and Voice alarm 13 are not yet actuated and transmitter unit $IR_{2P}$ 12 does not yet transmit signal 28.

When an automobile 30 is passing through entrance 9 or exit 9 (both entrance and exit are the same number since all their components and functions are the same), there will be 4 cases of different conditions to be considered.

Figure 10:
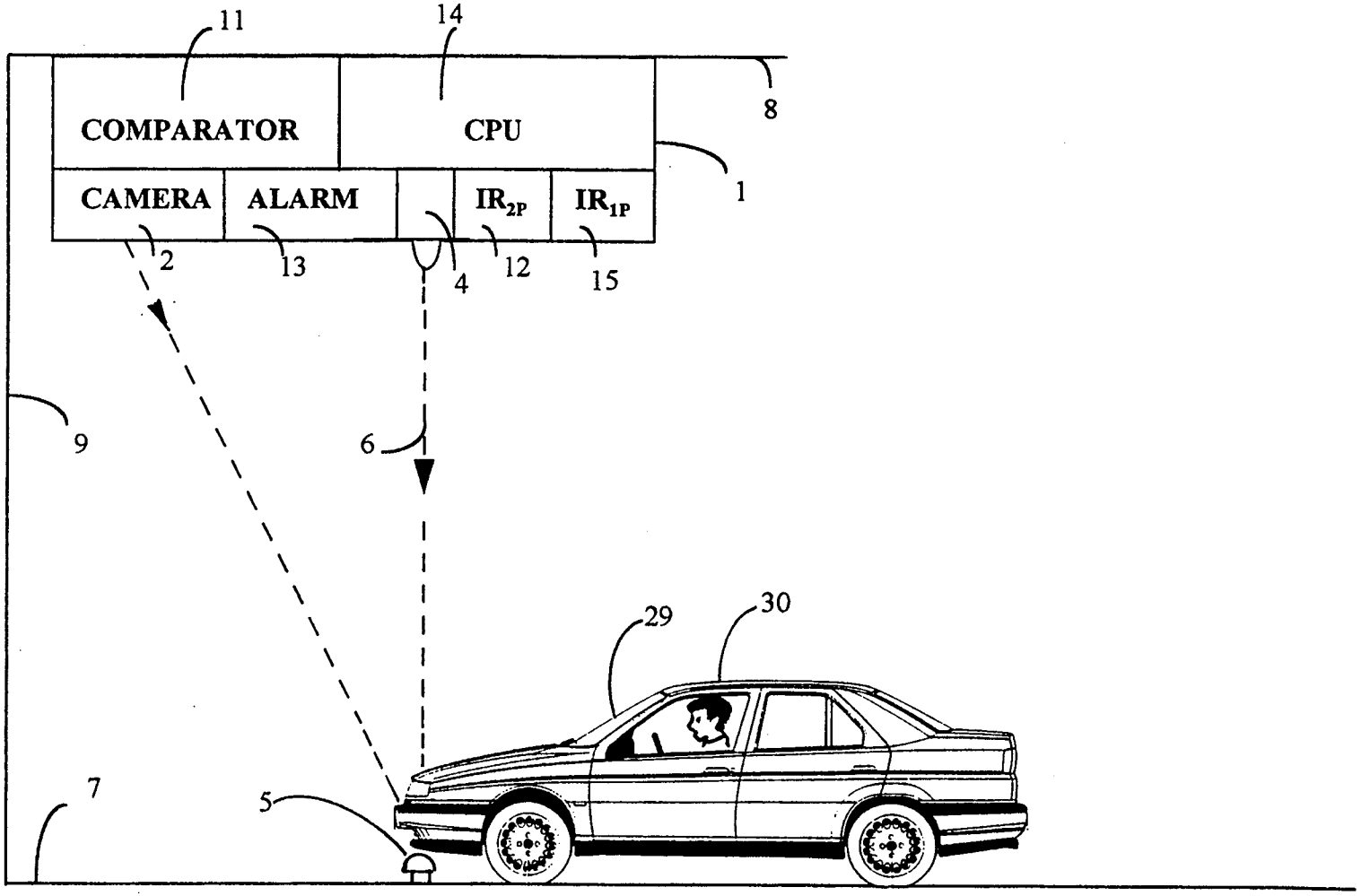
FIG. 10 shows the situation as in case I where the automobile passes the entrance or exit without a Secondary set.

CASE I: As shown in FIG. 10, when automobile 30 is passing through entrance 9 or exit 9 of expressway 35 without Secondary set 20 on board, there will be no transmission of signal 31 from transmitter unit $IR_{1S}$ 27 from the automobile 30 to receiver unit $IR_{1P}$ 15 of Primary set 1. Thus, there is no delay of actuations of camera 2 and voice alarm 13 by the CPU 14. The light beam 6 is blocked by the passing of automobile 30, therefore it does not reach the photosensitive receiving device section 5 on ground 7. Lacking in light reaching the photosensitive receiving device section 5 alters its output (such as voltage and/or resistance).

The change in the output is sensed by its detector's circuitry and then this data is sent to CPU 14 of Primary set 1 for processing. CPU 14, therefore, will actuate camera 2 and alarm 13. Camera 2 thus starts taking the picture of automobile 30 and its license plate and alarm 13 buzzes such that the toll authority can arrest the evading automobile.

Figure 11:
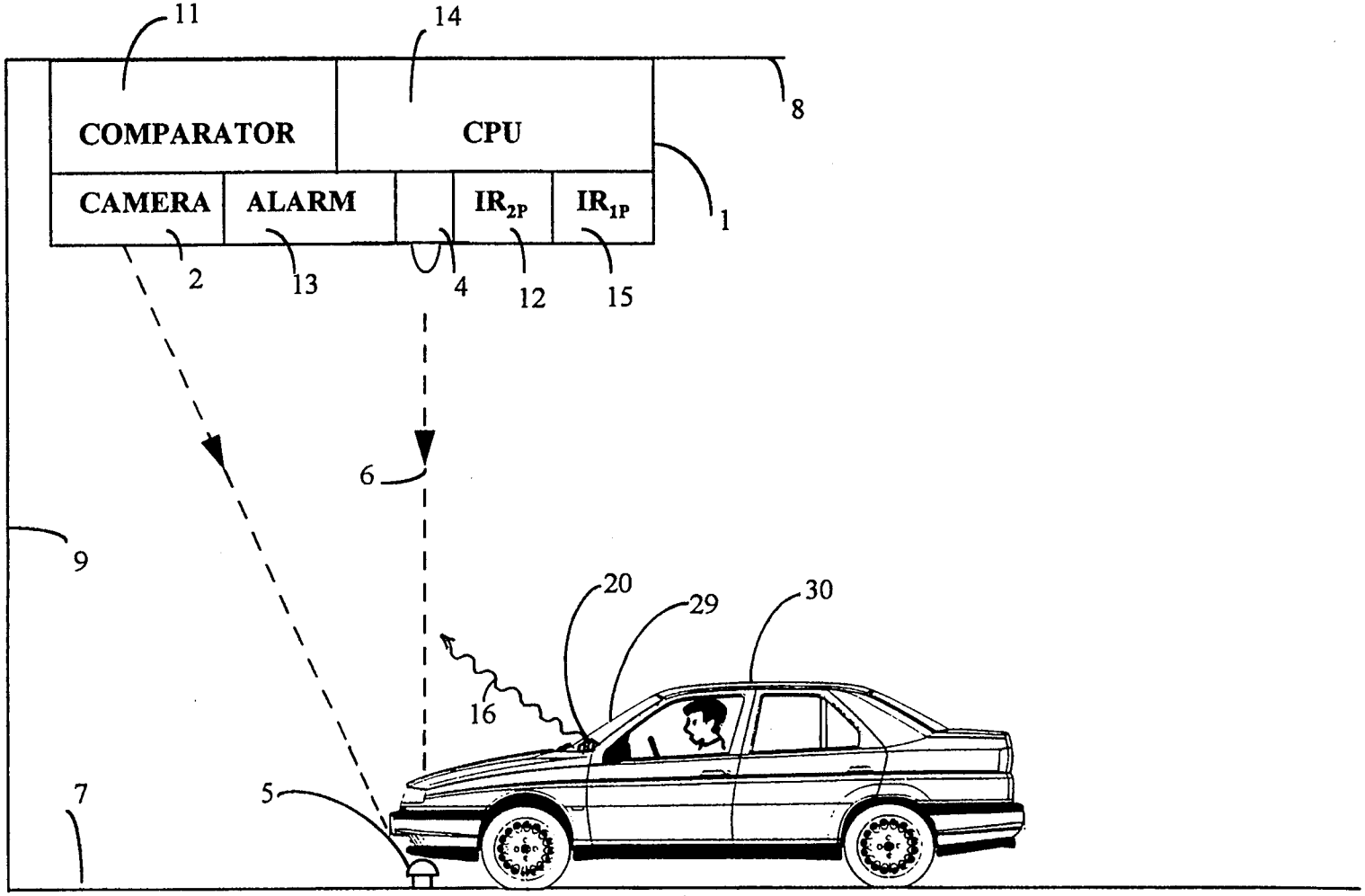
FIG. 11 shows the situation as in case II where a passing automobile has a Secondary set, however, the signal transmitted is incorrect since it is not tuned by the authorized agency.

CASE II: (FIG. 11) A vehicle has a Secondary set, however, the signal 16 transmitted from $IR_{1S}$ 27 is not correct, i.e. the magnetic card 21 inserted in the magnetc card reader/writer 22 is not issued by the responsible toll authority or the Secondary set used is not a correct one and is different from the one provided by the toll authority. When this car 30 passes through the toll facility, $IR_{1P}$ 15 receives incorrect signal from $IR_{1S}$ 27, the signal is sent to comparator 11 of Primary set 1 which recognizes that this is an incorrect signal. The data is sent to CPU 14 for processing. CPU 14 of the Primary set 1 thus, will not delay the actuation of camera 2 and voice alarm 13. The situation will then be as in CASE I when the light beam 6 is blocked by car 30.

Figure 12:
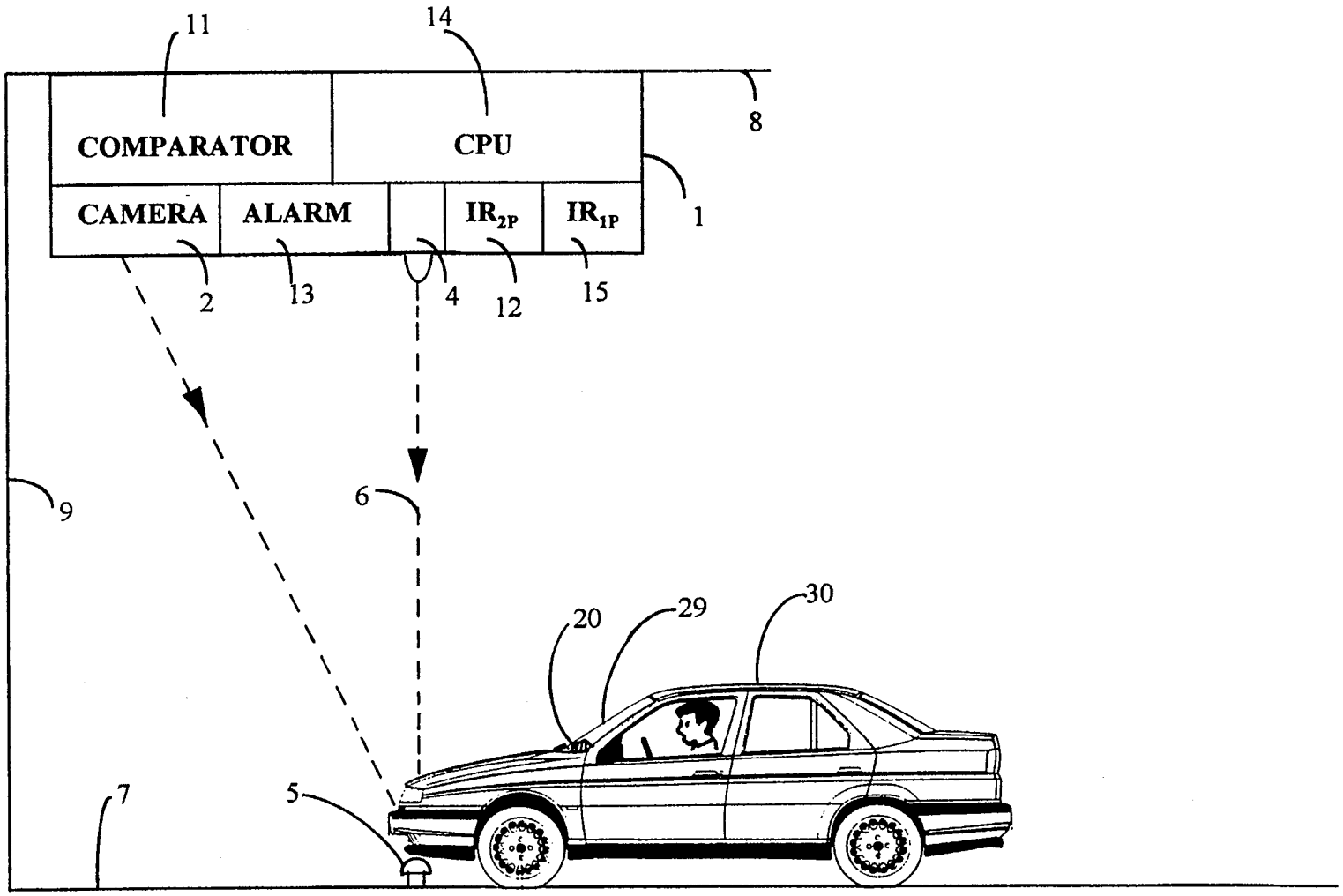
FIG. 12 shows the situation as in case III, a passing automobile having a Secondary set, however, the card is not valid.

CASE III: (FIG. 12) A vehicle having a Secondary set 20, however, the magnetic card 21 is not or not properly inserted, or is not the right one or is damaged or has insufficient amount to pay for the maximum toll for the longest distance of that expressway 35, card reader/writer 22 will inform the CPU 25 to trigger voice alarm 26 of the Secondary set to buzz, thereby the driver is notified that the card is not valid. In addition, the CPU 25 will not trigger transmitter unit $IR_{1S}$ 27 to transmit signal 31 to be received by $IR_{1P}$ 15. When this vehicle insists to pass through the entrance or the exit, the Primary set 1 will cause alarm 13 and camera 2 to function like that in CASE I.

Therefore, when alarm 26 is actuated, the driver has to change the magnetic card to an intact one by properly inserting the card 21 into the magnetic card reader/writer 22 just before he enters the entrance or the exit. If he has no extra pre-purchased card, he then has to move his car to a standard toll collecting booth and pay toll by cash.

CASE IV: When a vehicle is approaching entrance 9 or exit 9 at a normal driving speed up to 180 mph, an intact debit card with sufficient amount of money is properly inserted in the card holder of reader/writer 22. Thus, the Secondary set 20 is turned 'ON' by the insertion of the card. Card 21 and Secondary set 20 are obtained from the toll authorized agency. This is the situation where everything is correct. The card reader/-writer 22 will send the data to CPU 25 which will further delay alarm 26 to buzz and command transmitter unit $IR_{1S}$ 27 to transmit infrared signal 31 that can be received by the $IR_{1P}$ 15 of Primary set 1. In this case, the transmitters and receivers in Primary and Secondary sets will communicate with each other.

Figure 6:
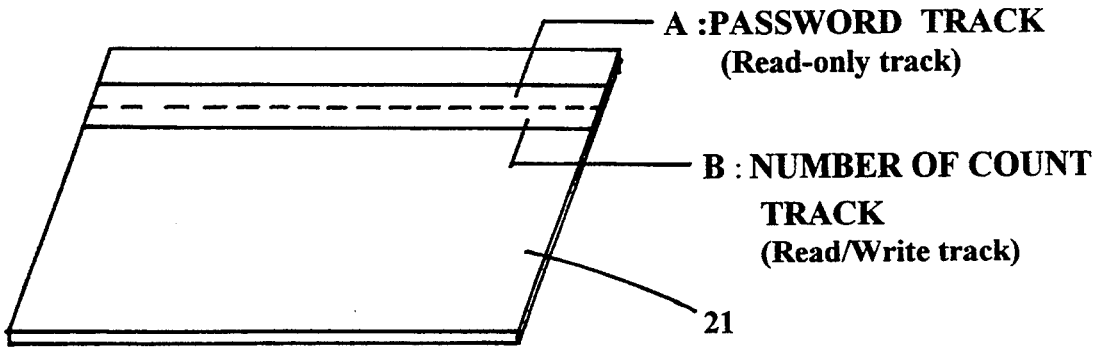
FIG. 6 shows a card like the telephone card that is used in this invention.
Figure 7:
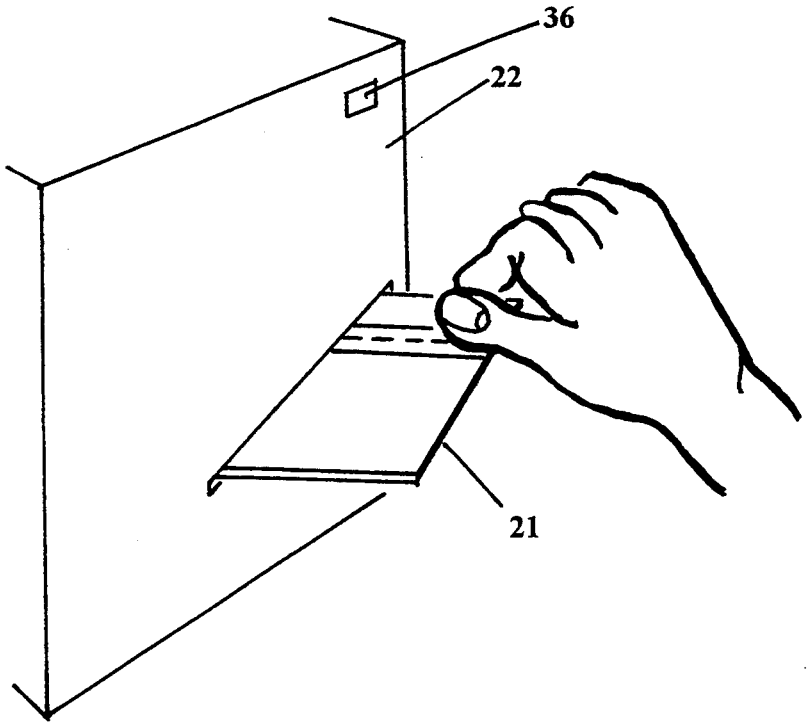
PRIOR ART FIG. 7
FIG. 7 shows how a card is inserted into a card reader/writer of a Secondary set.

A conventional card 21, as shown in FIG. 6, issued by expressway authority has all the features and operating means like those presently available TELEPHONE CARD of a preset value (not a credit card, and no need to identify the card owner). This can be either conventional magnetic card or the like such as optically coded card of LGZ, Landis & Gyr Zug AG, Zug, Switzerland (U.S. Pat. No. 5,101,184). The card contains information designated a set value assuming $100. The vehicle operator has to purchase the card from toll booths or any local toll facilities or at any locations authorized by the expressway authority. When such card 21 with a full amount of $100 is inserted properly into a conventional magnetic card reader/writer 22, screen 36 of card reader/writer unit 22 (FIG. 7) will display a number, i.e. 100.

Figure 13:
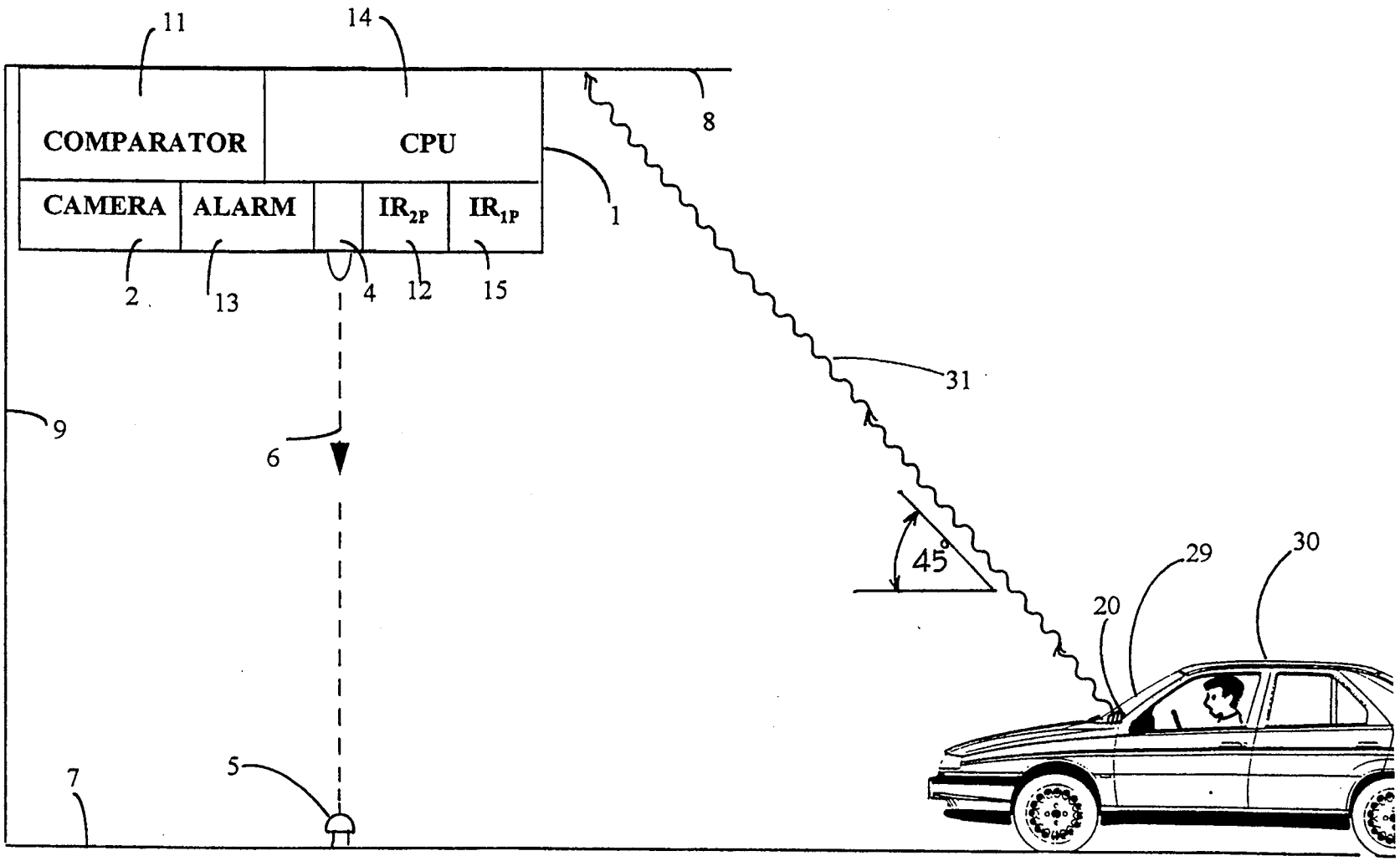
FIG. 13 shows the situation as in case IV where everything is correct. The automobile is about to move into the entrance or exit of the expressway. Signal is transmitted from $IR_{1S}$ of the Secondary set.

According to FIG. 13, when the vehicle 30 approaches near entrance No. 1 (about one half mile away from the toll plaza) into the vicinity of the Primary set 1 mounted beneath the ceiling 8 of the toll plaza 9, upon insertion of a prepaid portable card into the Secondary set 20, the Secondary set 20 is turned 'ON' and the card reader/writer 22 in the Secondary set 20 will read and send information that the inserted card 21 is a correct one to CPU 25. CPU 25 will withhold the actuation of alarm 26 and trigger the transmitter unit $IR_{1S}$ 27 to emit an infrared signal 31 transmitted through the front glass windshield 29 of the vehicle 30 at an angle of 45° towards the Primary set 1, as shown in FIG. 13.

Figure 14:
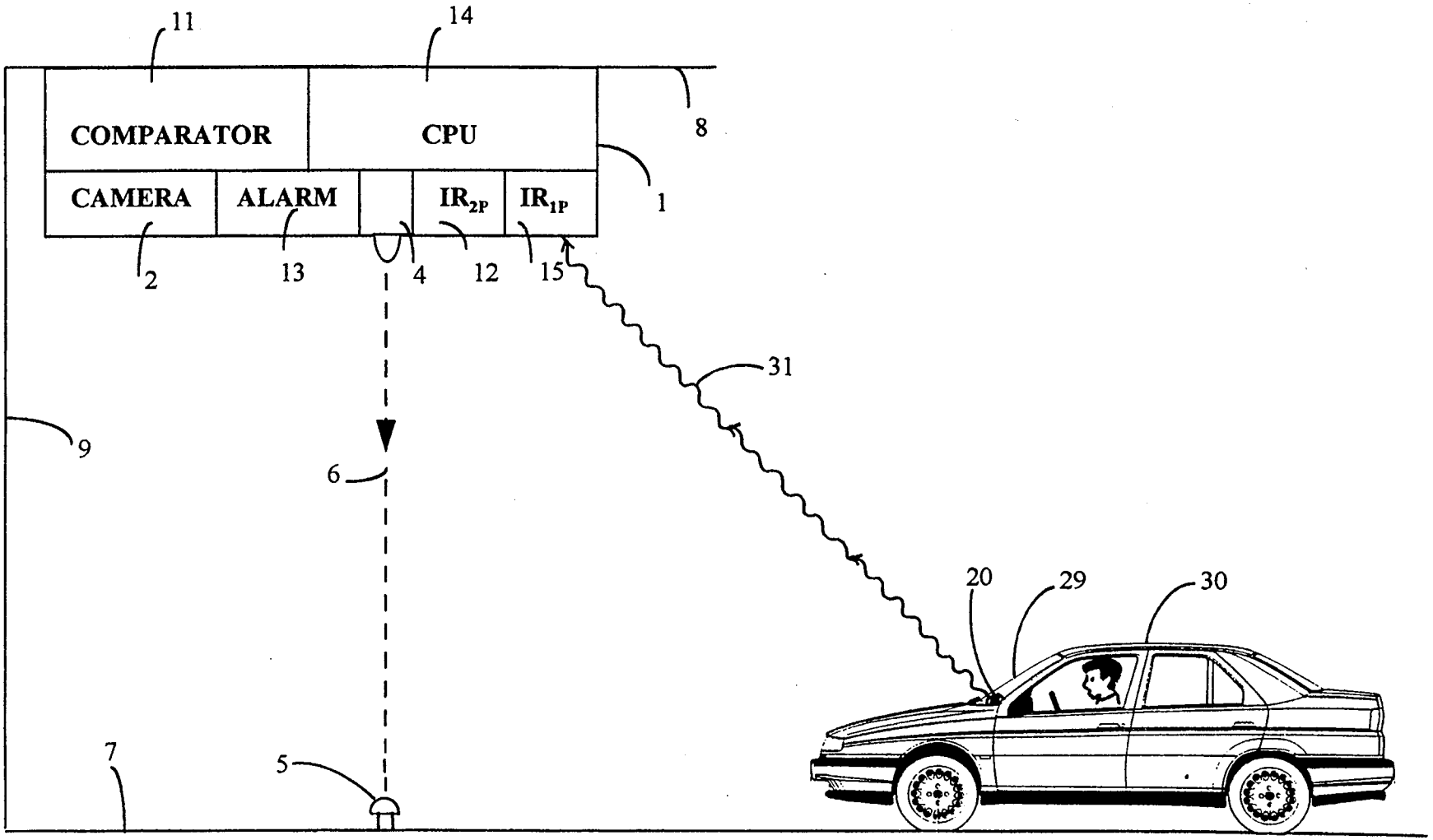
FIG. 14, as in case IV, shows that when the automobile moves near the entrance or exit, signal from $IR_{1S}$ is transmitted to and received by receiver unit $IR_{1P}$ of the Primary set thereby causes delay in actuation of camera and alarm in the Primary set.

When vehicle 30 moves further for a very short distance until the signal 31 from the transmitter unit $IR_{1S}$ 27 of Secondary set 20 which is transmitted at an angle of 45° can be received by the receiver unit $IR_{1P}$15 of the Primary set 1 as shown in FIG. 14.

Figure 15:
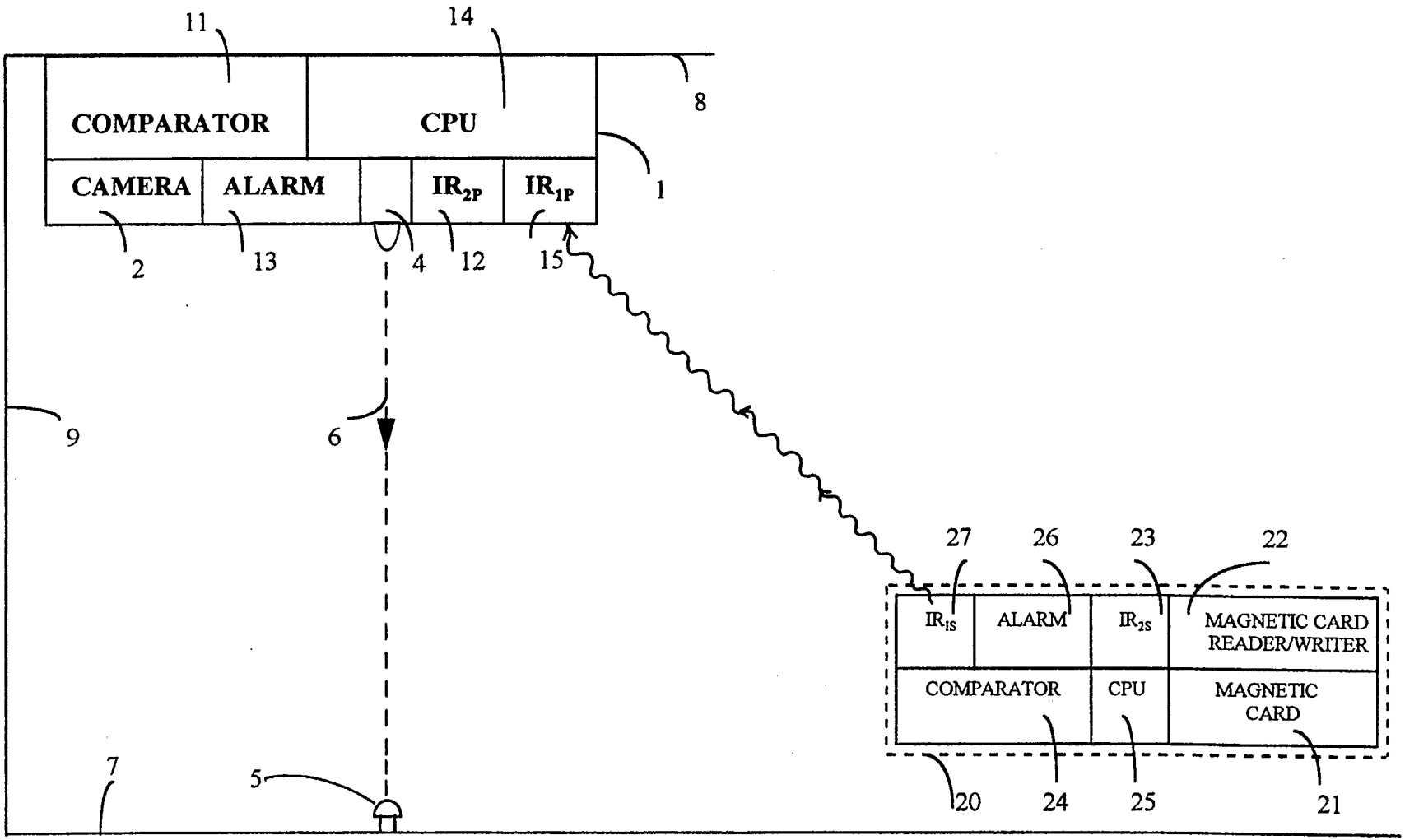
FIG. 15, as in case IV, shows how transmitter $IR_{1S}$ in Secondary set, shown as block diagram, transmits an infrared signal of specific frequency to be received by receiver unit $IR_{1P}$ of Primary set when the automobile enters the entrance or exit, as in FIG. 14.

FIG. 15 shows the block diagram of all the components which is shown in FIG. 14, and shows the transmission of infrared signal 31 from transmitter unit $IR_{1S}$ 27 of Secondary set 20 at the front glass windshield 29 of automobile 30 to receiver unit $IR_{1P}$15 of Primary set 1 at entrance No. 1.

$IR_{1P}$15 will send the information received to comparator 11. Comparator 11 will compare the signal and verify that the signal is correct (if this is not correct, then the situation proceeds like that in case II), and send the analysed information to CPU 14. CPU 14 thus processes the data and recognizes that the signal 31 from Secondary set 20 is correct. CPU 14 then delays the actuations of camera 2 that it does not take the picture and voice alarm 13 that it does not buzz.

Figure 16:
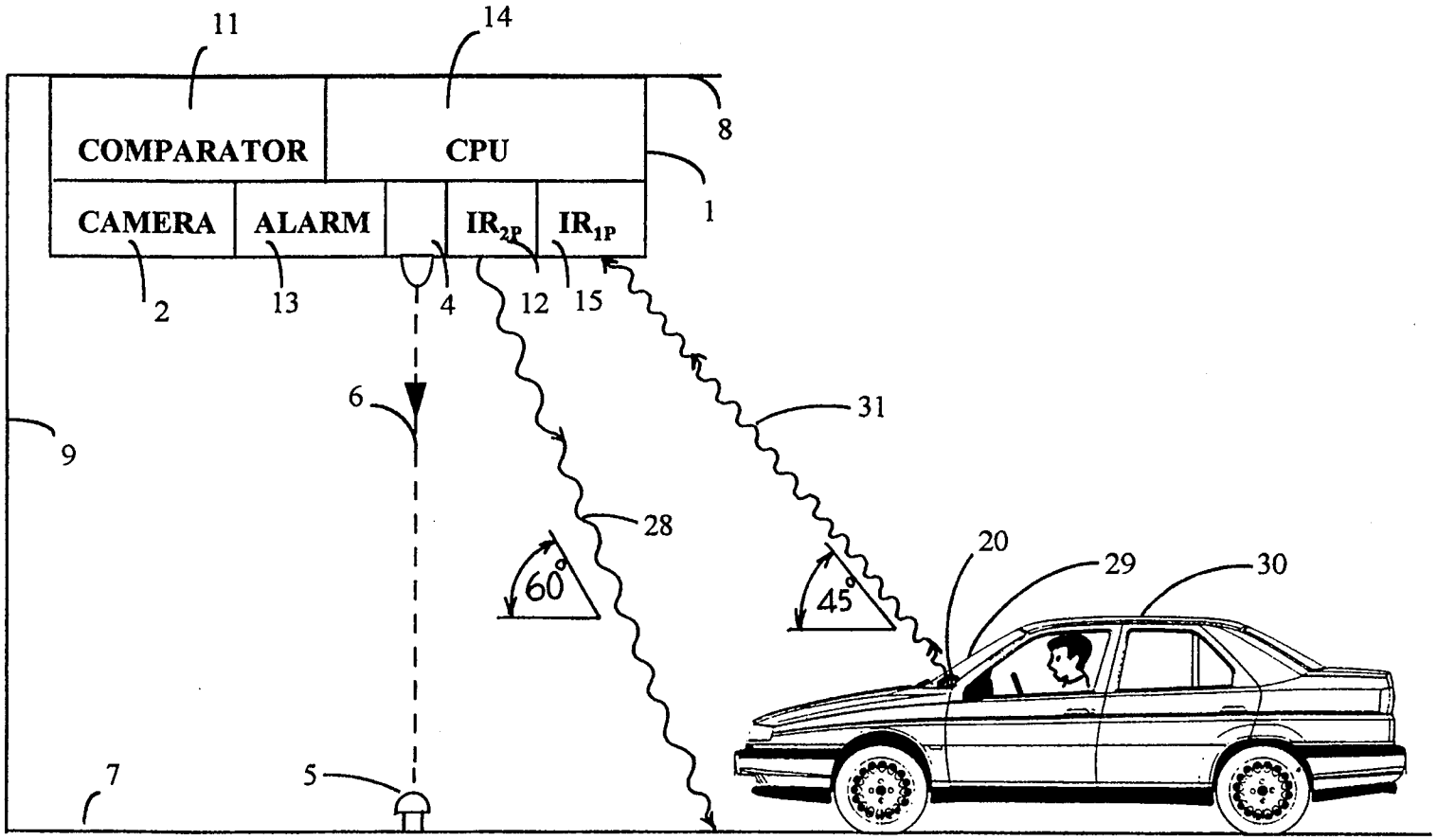
FIG. 16, as in case IV, when the automobile moves further for a very short distance; CPU 14 orders that transmitter unit $IR_{2P}$ of Primary set transmits a predetermined modulation frequency signal.

After a very short time interval, CPU 14 then commands the transmitter unit $IR_{2P}$ 12 to transmit an infrared signal 28 at an angle of 60° to the horizon (as shown in FIG. 16). This infrared signal is of a predetermined modulation frequency identifying each toll facility which is different from that of and other toll facilities of the expressway 35.

In the present invention, the transmitter unit $IR_{2P}$12 of Primary set 1 must transmit the infrared signal 28 at an angle of 60° to the horizon, and the transmitter unit $IR_{1S}$27 of Secondary set 20 must transmit infrared signal 31 at an angle of 45° to the horizon is that although these two angles can be of any degree, however, the angle of signal 31 needs to be smaller than that of signal 28. This is because signal 31 must be first received by receiver unit $IR_{1P}$15 of Primary set 1 such that CPU 14 can delay the actuations of camera 2 and alarm 13 before commanding the transmitter unit $IR_{2P}$12 to transmit signal 28 to be received by the receiver unit $IR_{2S}$23 of Secondary set 20 (see FIG. 3 and FIG. 16).

Figure 17:
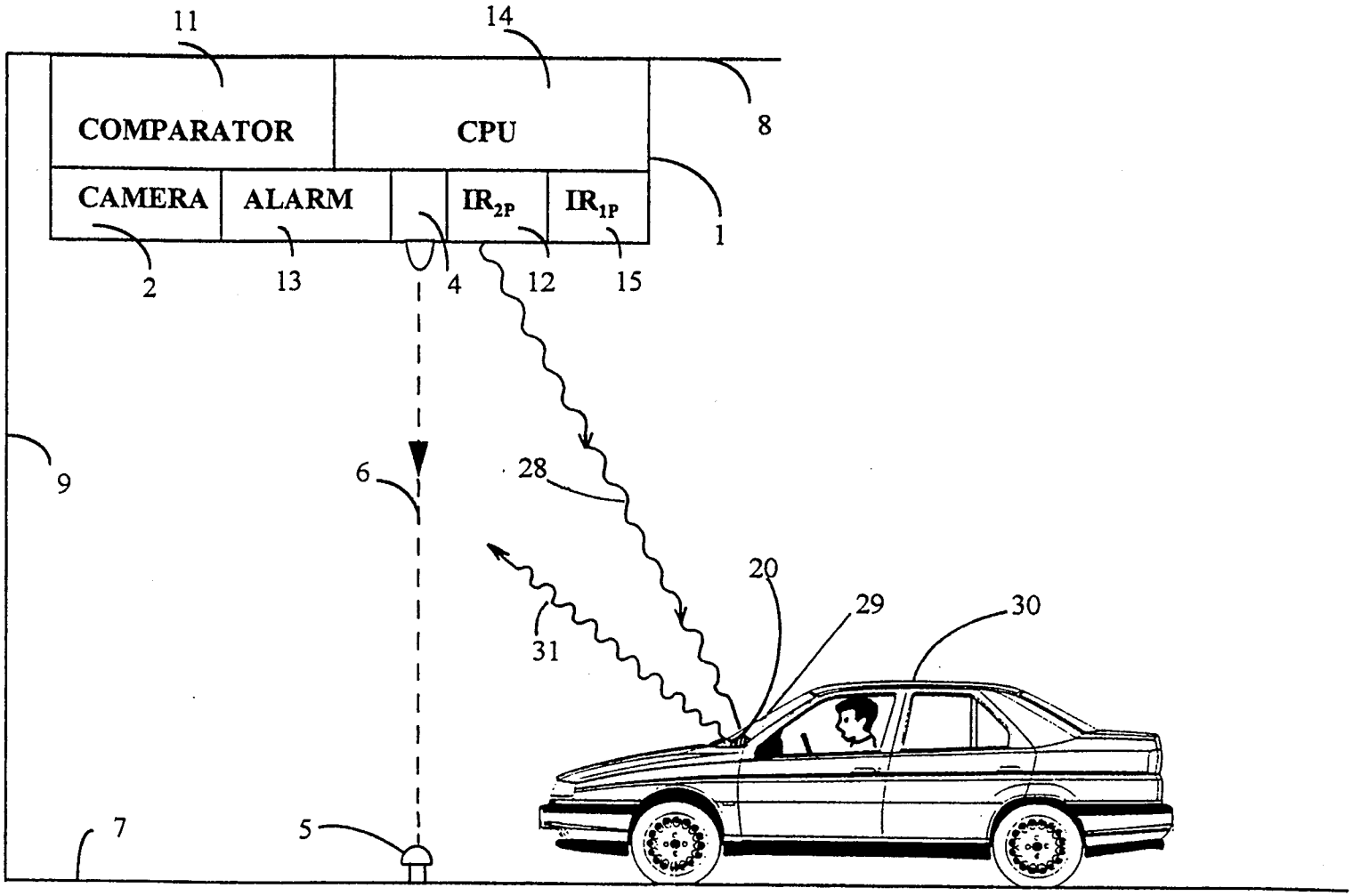
FIG. 17, as in case IV, shows how transmitter unit $IR_{2P}$ in Primary set transmits a predetermined modulation frequency signal to receiver unit $IR_{2S}$ in Secondary set.

FIG. 17 shows that when the automobile 30 moves a little bit further, the direction of signal 31 is moving away from the receiver unit $IR_{1P}$ 15 of the Primary set 1; where CPU 14 has already delayed the actuation of camera 2 and voice alarm 13.

In the mean time, signal 28 which is transmitted from transmitter unit $IR_{2P}$ 12 of Primary set 1 is received by receiver Unit $IR_{2S}$ 23 of Secondary set 20.

Figure 18:
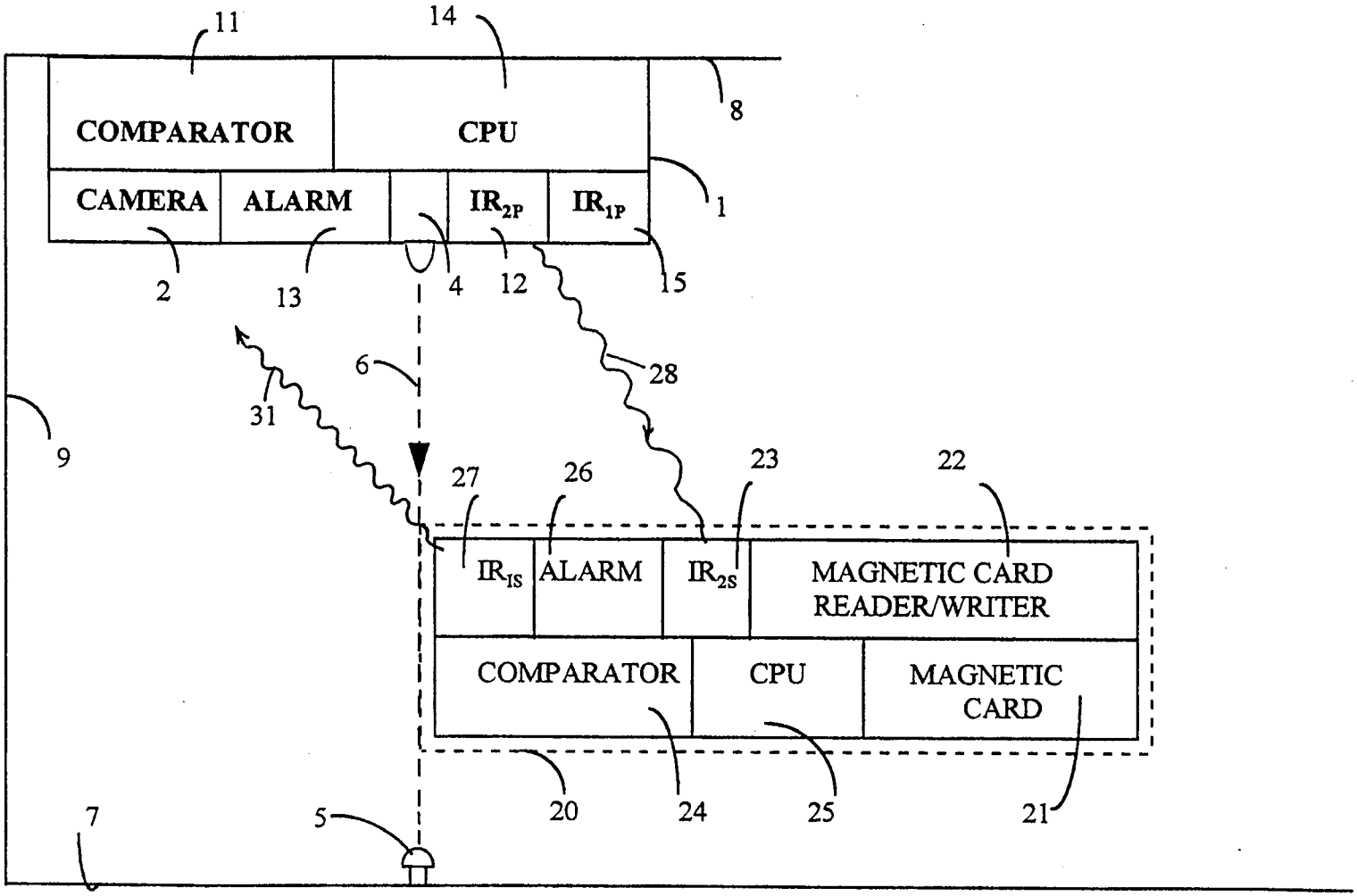
FIG. 18, shows the block diagram of all components of Primary and Secondary sets in a situation as in FIG. 17.

FIG. 18 is a block diagram of FIG. 17. This position is the most important position in the present invention. This figure shows how all the units and sections in Primary set 1 and Secondary set 20 communicate (note that presently car 30 is at the entrance No. 1 of expressway 35 as in FIG. 5).

Figure 19:
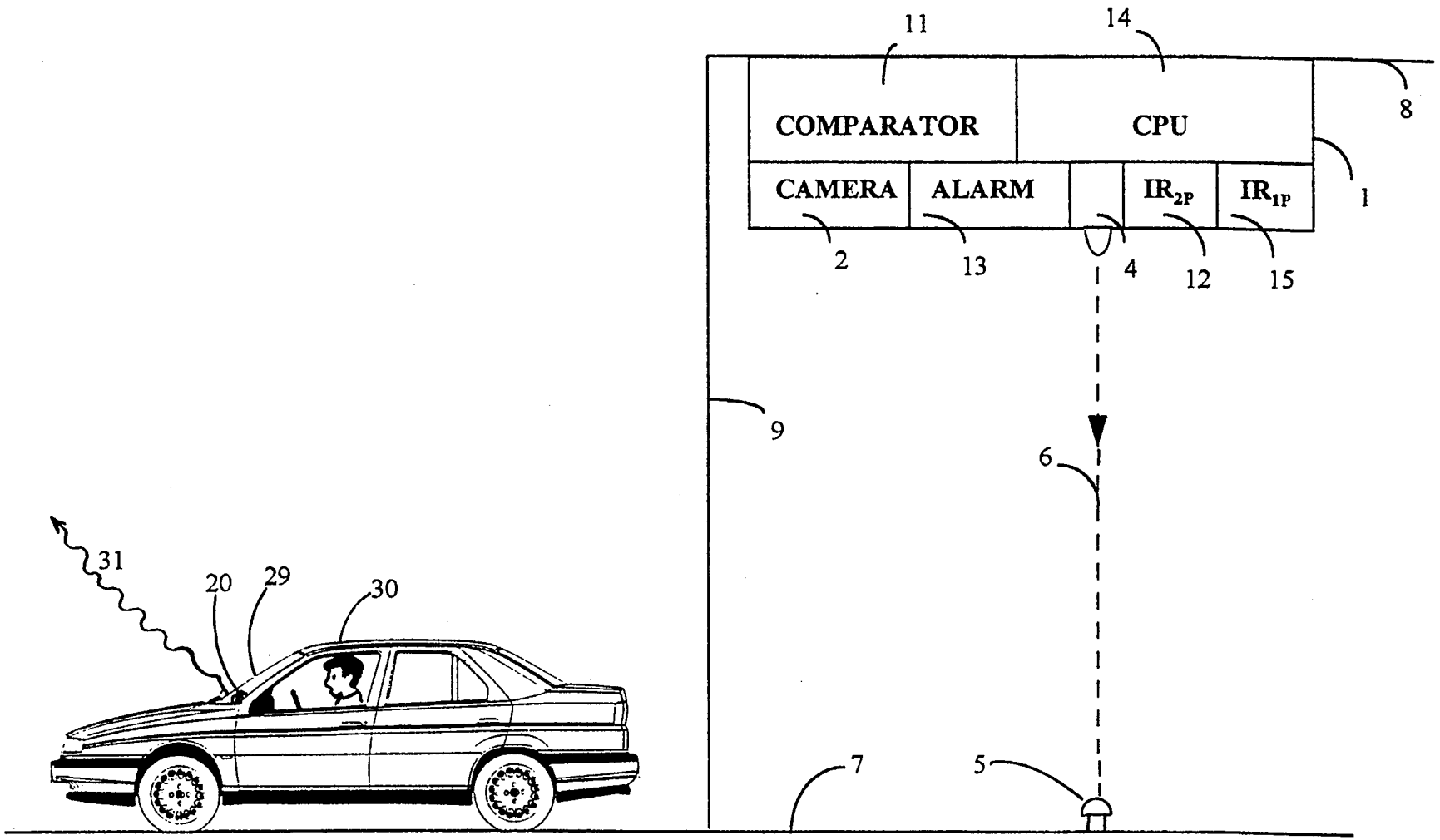
FIG. 19 shows the automobile is just moving away from the entrance of the expressway and is moving to the exit.
Figure 20A:
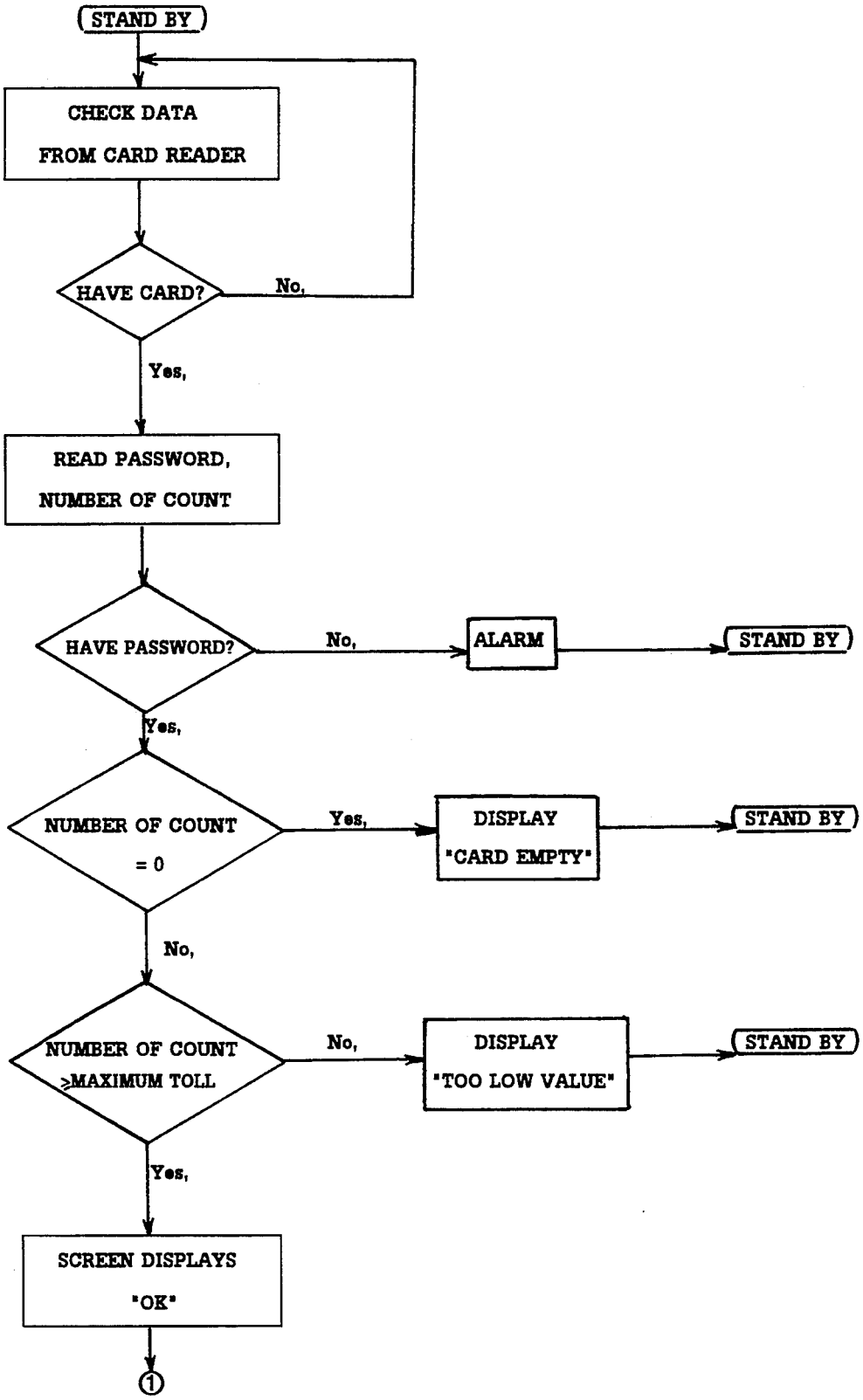
FIGS. 20A, 20B, and 20C show a flow diagram describing the various steps performed in a Secondary set.
Figure 20B:
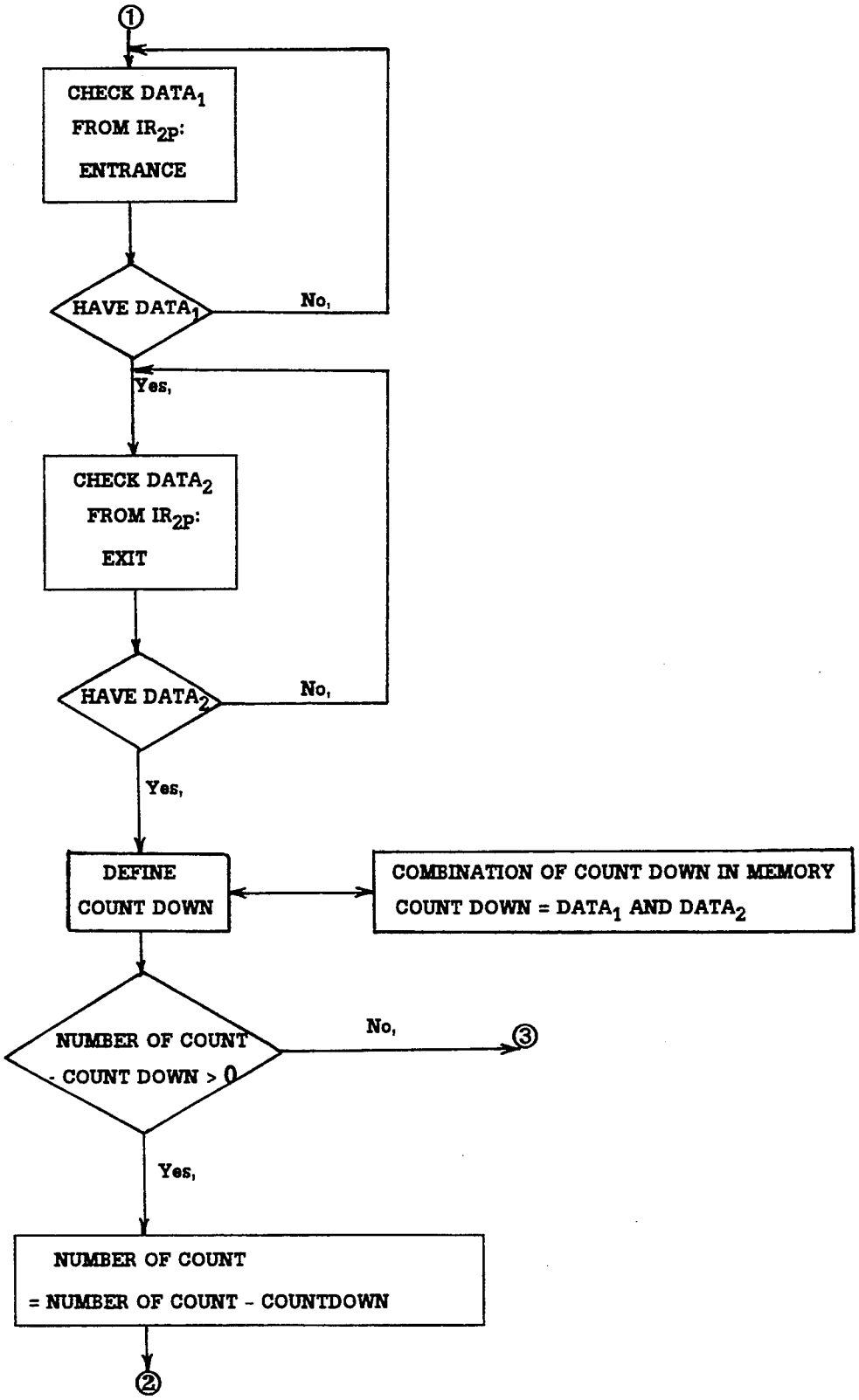
Figure 20C:
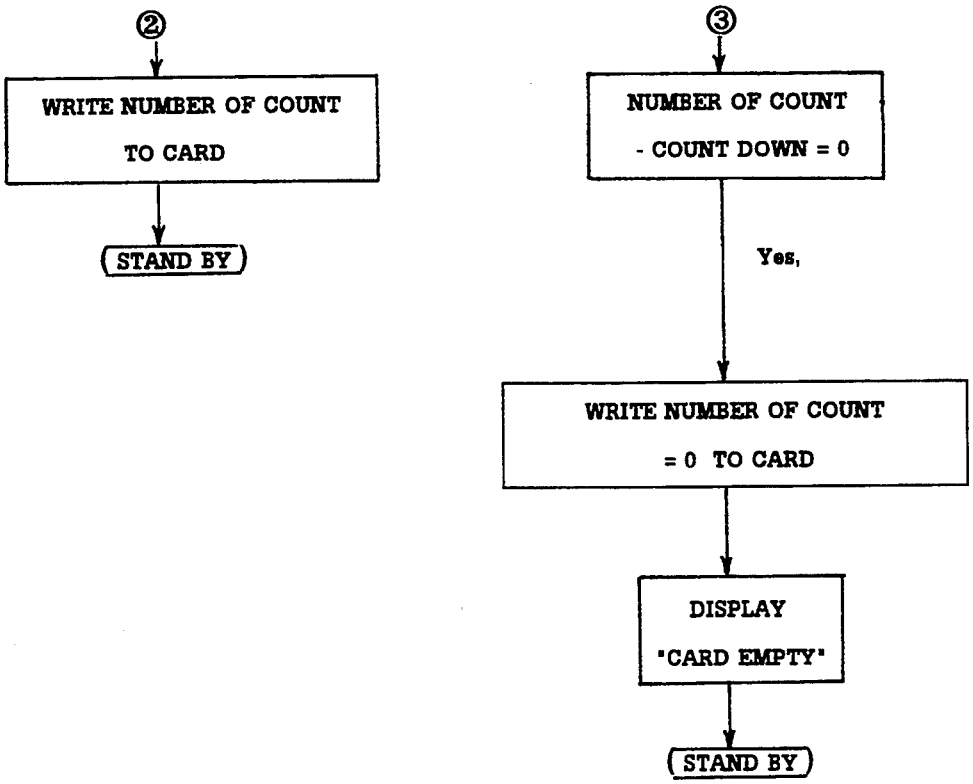

Assuming that CPU 14 actuates transmitter unit $IR_{2P}$ 12 in Primary set 1, the transmitter unit will emit an infrared signal 28 at a predetermined modulation frequency of 40 KHz for entrance No. 1 to receiver unit $IR_{2S}$ 23 in Secondary set 20. Comparator 24 in Secondary set 20 compares the signal received and sends the data to be stored in CPU 25 for further processing. FIG. 19 shows that car 30 is moving away from entrance No. 1 to proceed further to exit No. 9 of the expressway 35. Likewise, when car 30 approaches exit No. 9 of the expressway 35 as shown in FIG. 5, Primary set 1 at exit No. 9 and Secondary set 20 in car 30 will communicate in a similar manner as what has been described when car 30 was entering the entrance No. 1.

When a vehicle 30 enters the expressway at entrance No. 1 with a predetermined modulating frequency at 40 KHz and leaves at exit No. 9 with a predetermined modulation frequency at 60 KHz. As shown in FIG. 5, this is the longest distance that a maximum toll fee needs to be paid. When vehicle 30 passes through exit No. 9, the transmitter unit $IR_{2P}$12 of Primary set 1 at the exit No. 9 will transmit signal 28 at 60 KHz to the receiver $IR_{2S}$ 23 of Secondary set 20 which is placed in vehicle 30. Comparator 24 then compares the data received and sends to CPU 25 which in turn will process and execute the calculations necessary to determine the toll fee for that distance from the second data (60 KHz) and the first data (40 KHz), and the calculated toll is, for example, $10 to be charged for the distance between entrance No. 1 and exit No.9 which is the longest distance of the expressway 35. The CPU 25 will reduce the amount of money to be paid i.e. $10 by actuating the card reader/-writer 22 to rewrite a number "90" onto the card 21. This digital number "90" will be displayed on the screen 36 of card reader/writer 22 to inform the driver that only $90 is left in the card. In his next trip, if he enters at entrance No. 2 and leaves at exit No. 7, assuming the toll needs to be paid is $8. The amount in the card will be reduced by 8, thus he will be left with 90−8 which is 82.

Thus, for each utilization of the expressway, the amount of the toll will be deducted from the preset amount in the card. The amount of the money left will be shown on the screen 36 of card reader/writer 22. When the digital number shown on the screen 36 is less than 10 which is the maximum toll fee needed to enter this expressway (entering at entrance No. 1 and leaving at exit No. 9), this means that such card is no longer valid. The vehicle driver will be notified by voice alarm 26 in Secondary set 20 as in case III that he has to use a new pre-purchased card or to move to a standard toll booth and pay toll by cash. The driver can bring the used card to the toll road authority next time at his convenience when he wants to purchase a new card and gets his money refunded for the amount left in the previous used card.

If the driver insists to use the invalid card, the voice alarm 13 of the Primary set 1 will be actuated as in CASE III, where the driver will then be arrested and waste his time.

What has been described above is for an expressway which installed the primary sets both at the entrance and at the exit where the infrared signals of different and specific predetermined modulation frequencies identifying the toll facility at each entrance and each exit are used as communicating means between the primary sets and the in-vehicle secondary set. These two frequencies are received by the receiver in the secondary set and used for execution the calculation of toll needs to be paid for a certain distance, thereby deducted the calculated amount from the value present in the card inserted in the secondary set.

Likewise, in a highway, toll may be paid only at the entrance where at different entrances different tolls may be paid. The present invention may also be applied where the same concept may be slightly modified. A primary set is installed at only each entrance but not at the exit. The transmitter of the primary set transmits an infrared signal of a distinct predetermined modulation frequency specific only for each entrance. The signal is received by the receiver in the secondary set where the CPU in the secondary set uses this single predetermined modulation frequency signal for determining the toll needs to be paid at each entrance and thereby commands the card reader/writer of the secondary set to deduct the toll from the amount of money left in the card. For example, at entrance No. 3 of a highway, a signal of 35 KHz is transmitted. The toll needs to be paid may be $15. At entrance No. 4, a signal of 40 KHz is transmitted, of which a toll of $20 must be paid. Thus, at each entrance a different toll of specific amount for that certain entrance can be paid. Therefore, at different entrances different tolls can also be paid using the present invention. The present invention can also be used in any automatic toll-collection either for fixed or variable tolls.

It is obvious that the present invention efficiently fulfills all objectives mentioned above. It will also be apparent to those skilled in the art that all matter contained in the above description or shown in the accompanying drawings be interpreted as illustrative rather than in a limiting sense. Various modifications can be made without departing from the spirit or scope of the toll paying system of the present invention. All variations and modifications of this invention are included herein, provided they come within the scope of the appended claims and their equivalents.

It is also to be understood that the following claims are intended to cover all of the generic and specific features of the invention as described herein, and all statements of the scope of the invention which, as a matter of language, might be said to fall therebetween.

I claim:

1. A method for automatically collecting tolls from a vehicle moving along a tollroad, comprising the steps of:

providing a first transceiving means positioned at a fixed position relative to a tollroad one at an entrance and one at an exit, and a second transceiving means equipped in an in-vehicle device which is carried in a moving vehicle;

providing a first toll facility at said entrance equipped with said first transceiving means through which said vehicle can enter for toll collection;

transmitting an infrared signal from a transmitter of said second transceiving means in said in-vehicle device to communicate with said transceiving means at said first toll facility;

activating said transmitter of said transceiving means at said first toll facility upon receiving of said infrared signal to transmit another infrared signal of a predetermined modulation frequency identifying said first toll facility at said entrance back to the receiver of said second transceiving means of said in-vehicle device;

storing information of the received signal by a data processing means of said in-vehicle device into its memory;

providing a second toll facility equipped with said transceiving means at said exit through which said vehicle can exit;

activating said transmitter of said transceiving means at said second toll facility by said infrared signal from said second transceiving means in the same manner as at said first toll facility to transmit an infrared signal of a different predetermined modulation frequency identifying said second toll facility at said exit to said receiver of said second transceiving means;

calculating toll by said data processing means of said in-vehicle device by using information from said infrared signals received at said entrance and said exit by said second transceiving means;

debiting the calculated toll amount from a cash balance present in a portable information storing means; and instructing by said data processing means a card reader/writer of said in-vehicle device to overwrite said cash balance with the resulting new cash balance in said information storing means.

2. The method of claim 1 wherein said portable information storing means is a prepaid card which stores a cash balance available for making toll payments.

3. The method of claim 2 wherein said prepaid portable card is a card that can be magnetically encoded and decoded.

4. The method of claim 1, further comprising the step of using said data-processing means in said in-vehicle device before entering of said moving vehicle through said entrance for comparing the maximum toll amount for said tollroad with said cash balance recorded in said prepaid portable card whether said cash balance is equal to or greater than the maximum toll.

responding to the result of said comparison that said cash balance is equal to or greater than said maximum toll by actuating said transmitter of said in-vehicle device to communicate with said transceiving means of said first toll facility at said entrance such that the activation of an alarm and a camera at said first toll facility are cancelled and the driver of said moving vehicle is allowed to proceed through said first toll facility.

5. The method of claim 4, wherein the responding step includes the step of responding by providing the driver of said vehicle an alarm signal from said in-vehicle device when said comparison indicates that said cash balance recorded in said prepaid card is less than said maximum toll for that tollroad.

6. The method of claim 5, wherein additional responding step includes, activation of an alarm at said first toll facility to notify the toll authority and actuation of a camera at said toll facility to take the picture of said vehicle together with its license plate when said driver carrying said prepaid portable card with said insufficient cash balance for paying the maximum toll or with no authorized means of paying toll insists to pass through said automatic toll facility.

7. An automatic system for collection of toll from a moving vehicle comprises a roadside communication means installed at each toll booth, located at a fixed position relative to a tollroad, one at each entrance and one at each exit, to communicate with an in-vehicle device installed in said moving vehicle by transmitting-/receiving infrared signals to/from each other, said roadside communication means comprising:

a receiver for receiving an infrared signal from a transmitter of said in-vehicle device in said moving vehicle;

a transmitter to transmit an infrared signal of a predetermined modulation frequency identifying each toll booth to a receiver of said in-vehicle device in said moving vehicle;

an alarm to notify toll authority of an unauthorized use of said tollroad by an audible signal;

a camera to take the picture of a license plate of said unauthorized invading vehicle trying to pass through said toll facility;

a data processing means, capable of communicating with said receiver and said transmitter, verifying the authenticity of said infrared signal received and actuating said alarm and said camera when said received signal is not an authentic one;

said in-vehicle device comprising:

means for portably storing information;

means for encoding/decoding data into said portable information storing means;

means to transmit an infrared signal to communicate with said receiver of said roadside communication means;

means to receive infrared signals of predetermined modulation frequencies identifying said toll facilities at said entrance and said exit from said roadside communication means;

means to calculate toll using information from two infrared signals received from said roadside communication means one at said entrance and another at said exit of said tollroad, to debit toll from a cash balance present in said information storing means and to instruct said means for encoding/decoding data to overwrite said cash balance with the resulting new cash balance in said information storing means.

8. An automatic system for collection of toll of claim 7, wherein each toll facility at said entrance and said exit of said tollroad is identified by an infrared signal of a different predetermined modulation frequency transmitted from said transceiving means of said toll facility to be received by said receiver of said transceiving means in said in-vehicle device.

* * * * *